US012747863B2

(12) United States Patent
Zelina et al.

(10) Patent No.: US 12,747,863 B2
(45) Date of Patent: Sep. 29, 2026

(54) DUAL FUEL COMBUSTOR FOR A TURBINE ENGINE

(71) Applicant: General Electric Company, Schenectady, NY (US)

(72) Inventors: Joseph Zelina, Waynesville, OH (US); Sibtosh Pal, Mason, OH (US); Michael T. Bucaro, Arvada, CO (US); Pradeep Naik, Bengaluru (IN); Steven C. Vise, Loveland, OH (US); Andrew Wickersham, Liberty Township, OH (US); Nicholas R. Overman, Sharonville, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/630,445

(22) Filed: Apr. 9, 2024

(65) Prior Publication Data

US 2025/0314382 A1 Oct. 9, 2025

(51) Int. Cl.

| | |
|---|---|
| ***F23R 3/34*** | (2006.01) |
| ***F23R 3/00*** | (2006.01) |
| ***F23R 3/36*** | (2006.01) |

(52) U.S. Cl.

CPC ..... *F23R 3/346* (2013.01); *F23R 3/002* (2013.01); *F23R 3/36* (2013.01); *F23R 3/34* (2013.01); *F23R 2900/00014* (2013.01)

(58) Field of Classification Search

CPC .... F23R 2900/00014; F23R 3/34; F23R 3/36; F23R 3/346; F23R 3/002

See application file for complete search history.

(56) References Cited

U.S. PATENT DOCUMENTS 4,192,139 A 3/1980 Buchheim
4,455,839 A * 6/1984 Wuchter ..... F23R 3/58 60/737

(Continued)

FOREIGN PATENT DOCUMENTS

CN 111006244 B 2/2021
EP 1055879 A1 11/2000

(Continued)

OTHER PUBLICATIONS

Nath et al., U.S. Appl. No. 18/326,639, filed May 31, 2023.

(Continued)

*Primary Examiner* — Thomas P Burke
(74) *Attorney, Agent, or Firm* — Carter, DeLuca & Farrell, LLP

(57) ABSTRACT

A combustor of a turbine engine includes a first combustion zone operable to combust a first fuel and air mixture, a first fuel inlet for providing a first fuel, a first air inlet for providing first zone air, the first fuel and the first zone air combining to form the first fuel and air mixture in the first combustion zone, a second combustion zone operable depending on turbine engine operating parameters, for combusting a second fuel and air mixture, a second fuel inlet providing a second fuel, that operates when the second combustion zone is operating and does not operate when the second combustion zone is not operating, and a second air inlet providing second zone air, the second fuel and the second zone air combining to form the second fuel and air mixture in the second combustion zone, wherein the first fuel and the second fuel are disparate fuels.

16 Claims, 13 Drawing Sheets

(56) References Cited

U.S. PATENT DOCUMENTS

| | | | | |
|---|---|---|---|---|
| 6,481,209 | B1 * | 11/2002 | Johnson | F23R 3/346 60/750 |
| 6,951,108 | B2 | 10/2005 | Burrus et al. | |
| 8,272,219 | B1 | 9/2012 | Johnson et al. | |
| 8,549,862 | B2 | 10/2013 | Kendrick | |
| 8,689,562 | B2 | 4/2014 | Kendrick | |
| 9,068,751 | B2 | 6/2015 | Snyder | |
| 9,638,423 | B2 | 5/2017 | Ogata et al. | |
| 10,222,066 | B2 | 3/2019 | Chen et al. | |
| 10,436,450 | B2 | 10/2019 | Crawley et al. | |
| 10,941,940 | B2 | 3/2021 | Bulat et al. | |
| 10,976,053 | B2 | 4/2021 | Boardman et al. | |
| 11,073,286 | B2 | 7/2021 | Boardman et al. | |
| 11,143,407 | B2 | 10/2021 | Hoke et al. | |
| 11,313,561 | B2 | 4/2022 | Roh | |
| 11,371,710 | B2 | 6/2022 | Bulat | |
| 11,668,462 | B1 | 6/2023 | Benjamin et al. | |
| 11,828,469 | B2 | 11/2023 | Overman et al. | |
| 2004/0103663 | A1 | 6/2004 | Haynes et al. | |
| 2006/0107667 | A1 | 5/2006 | Haynes et al. | |
| 2011/0185735 | A1 * | 8/2011 | Snyder | F23R 3/346 60/746 |
| 2012/0023964 | A1 | 2/2012 | Mehring | |
| 2014/0007578 | A1 | 1/2014 | Genin et al. | |
| 2016/0033131 | A1 * | 2/2016 | Ogata | F23R 3/46 60/737 |
| 2018/0252410 | A1 | 9/2018 | Zelina et al. | |
| 2019/0017441 | A1 * | 1/2019 | Venkatesan | F23R 3/002 |
| 2019/0086092 | A1 * | 3/2019 | Boardman | F23R 3/18 |
| 2019/0120493 | A1 * | 4/2019 | Boardman | F02C 3/14 |
| 2019/0162414 | A1 | 5/2019 | Ogata et al. | |
| 2019/0212009 | A1 * | 7/2019 | Boardman | F23R 3/58 |
| 2023/0175435 | A1 | 6/2023 | Benjamin et al. | |
| 2023/0250961 | A1 | 8/2023 | Ganiger et al. | |
| 2023/0258148 | A1 | 8/2023 | Ledwith, Jr. | |
| 2023/0400187 | A1 | 12/2023 | Ganiger et al. | |
| 2024/0110520 | A1 * | 4/2024 | Dudebout | F23R 3/36 |

FOREIGN PATENT DOCUMENTS

| | | | |
|---|---|---|---|
| EP | 2427694 | A1 | 3/2012 |
| EP | 3450850 | A1 | 3/2019 |

OTHER PUBLICATIONS

Nath et al., U.S. Appl. No. 18/326,647, filed May 31, 2023.
Nath et al., U.S. Appl. No. 18/326,665, filed May 31, 2023.
Nath et al., U.S. Appl. No. 18/326,669, filed May 31, 2023.
Naik et al., U.S. Appl. No. 18/476,595, filed Sep. 28, 2023.
Naik et al., U.S. Appl. No. 18/477,597, filed Sep. 29, 2023.
Burrus, et al., "Performance Assessment of a Prototype Trapped Vortex Combustor Concept for Gas Turbine Application," ASME ITGI Turbo Expo 2001, New Orleans, Louisiana, USA (2001).
Joseph Zelina, "Technical Article: Revolutionary Combustors for Future Propulsion Systems," Mechanical Engineering: The Magazine of ASME, Global Gas Turbine News, vol. 53, No. 4, p. 51 (2013).
Extended European Search Report for application No. 25162911.9 dated Jul. 4, 2025, 9 pages.
European Office Action for Application No. 25 162 911.9 dated Jul. 16, 2026, 8 pages.

* cited by examiner

DUAL FUEL COMBUSTOR FOR A TURBINE ENGINE

TECHNICAL FIELD

The present disclosure relates generally to a turbine engine, and, more specifically, a turbine engine configured to burn multiple different fuels.

BACKGROUND

Turbine engines, for example, for aircraft, generally include a fan and a core section arranged in flow communication with one another. A combustor section receives and mixes fuel and air for combustion. The combustor is configured to combust disparate fuels, for example, Jet A and hydrogen. The different combustion properties of each of the disparate fuels dictate different properties of a respective combustion chamber of the combustor. Further, the combustor may be reconfigurable to run on one of the two disparate fuels.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
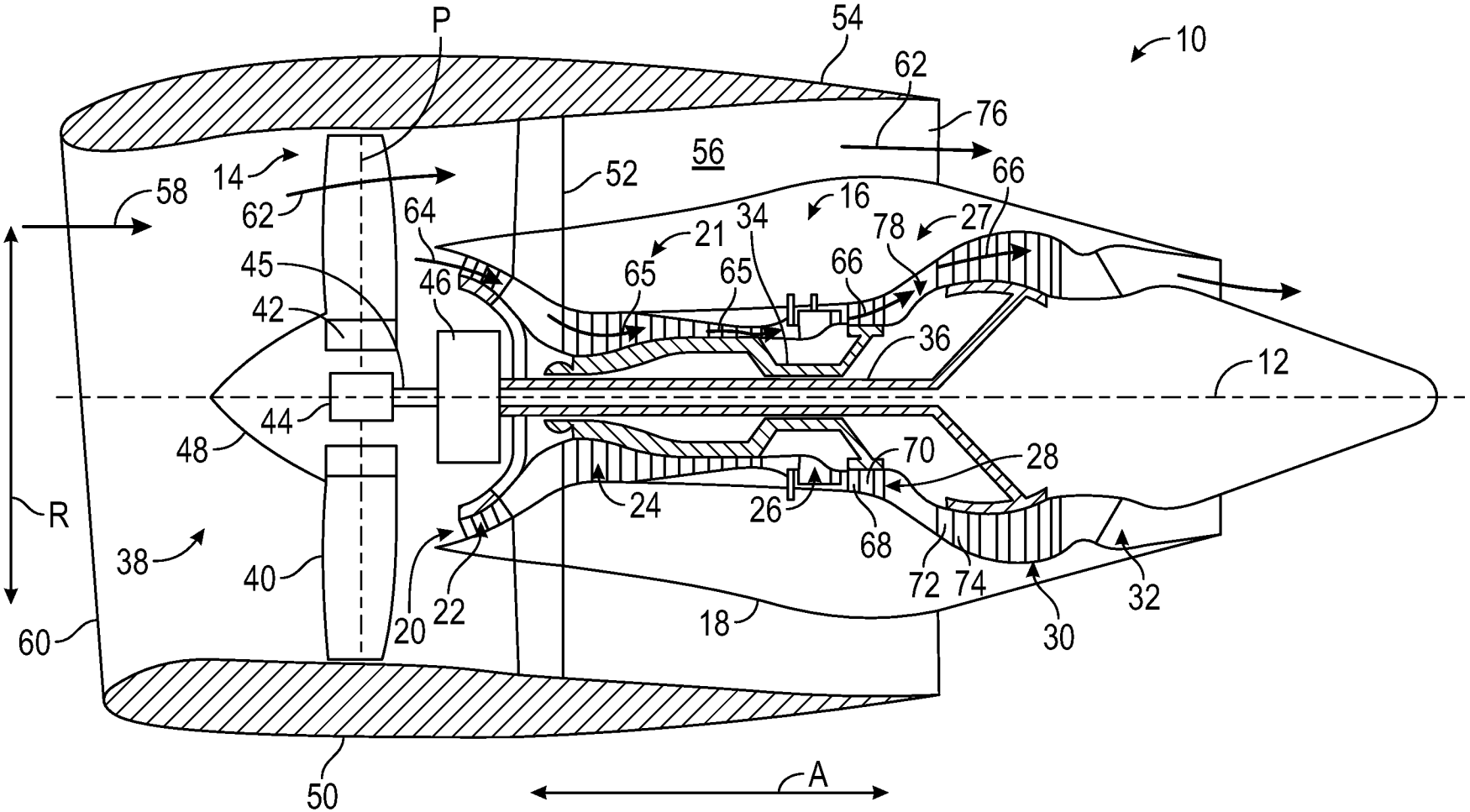
FIG. 1 is a schematic cross-sectional view of a turbine engine, taken along a longitudinal centerline axis of the turbine engine, according to the present disclosure.

Features, advantages, and embodiments of the present disclosure are set forth or apparent from a consideration of the following detailed description, drawings, and claims. Moreover, the following detailed description is exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the present disclosure.

As used herein, the terms "first," "second," and "third" may be used interchangeably to distinguish one component from another and are not intended to signify location or importance of the individual components. However, when discussing related components, those components with the same terms, are corresponding components.

As used herein, the term "first zone air" refers to air received into a "first combustion zone" to be mixed with a "first fuel" to form a "first fuel and air mixture." Likewise, "second zone air" refers to air received into a "second combustion zone" to be mixed with a "second fuel" to form a "second fuel and air mixture," and "third zone air" refers to air received into a "third combustion zone" to be mixed with a "third fuel" to form a "third fuel and air mixture."

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "forward" and "aft" refer to relative positions within a turbine engine or vehicle, and refer to the normal operational attitude of the turbine engine or vehicle. For example, with regard to a turbine engine, forward refers to a position on the turbine engine that is closer to the propeller or the fan and aft refers to a position on the turbine engine that is further away from the propeller or the fan.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. The term "inboard" refers to a position relatively radially closer to the centerline of the turbine engine, and, conversely, the term "outboard" refers to a position relatively radially farther from the centerline of the turbine engine. In addition, as used herein, the terms "circumferential" and "circumferentially" refer to directions and orientations that extend arcuately about the centerline of the turbine engine.

As used herein, the terms "low" and "high," or their respective comparative degrees (e.g., "lower" and "higher", where applicable), when used with compressor, combustor, turbine, shaft, fan, or turbine engine components, each refers to relative pressures, relative speeds, relative temperatures, or relative power outputs within an engine unless otherwise specified. For example, a "low-power" setting defines the engine or the combustor configured to operate at a power output lower than a "high-power" setting of the engine or the combustor. The terms "low" or "high" in such aforementioned terms may additionally, or alternatively, be understood as relative to minimum allowable speeds, pressures, or temperatures, or minimum or maximum allowable speeds, pressures, or temperatures relative to normal, desired, steady state, etc., operation of the engine. A mission cycle for a turbine engine includes, for example, a low-power operation and a high-power operation. Low-power operation includes, for example, engine start, idle, taxiing, and approach. High-power operation includes, for example, takeoff and climb.

The terms "coupled," "attached," "connected," and the like, refer to both direct coupling, fixing, attaching, or connecting, as well as indirect coupling, fixing, attaching, or connecting through one or more intermediate components or features, unless otherwise specified herein.

The singular forms "a," "an," and "the" include plural references unless the context clearly dictates otherwise.

The term "residence time" refers to the time required for a fuel to mix with the oxygen in a combustor so a chemical reaction (burning) can occur in the combustor. When applied to a liquid fuel, the term "residence time" additionally refers to the time required for the fuel to evaporate in the combustor. Residence time is dependent on the chemical and/or physical properties of the fuel and the operating conditions of the combustor. For otherwise equivalent combustors, liquid fuels such as Jet-A require a longer residence time, while gaseous fuels such as hydrogen require a shorter residence time.

The term "disparate fuels" as used herein, refers to fuels combusted in a turbine engine with significantly different resident times, requiring differently sized combustion zones.

Approximating language, as used herein throughout the specification and claims, is applied to modify any quantitative representation that could permissibly vary without resulting in a change in the basic function to which it is related. Accordingly, a value modified by a term or terms, such as "approximately," "generally," and "substantially" is not to be limited to the precise value specified. In at least some instances, the approximating language may correspond to the precision of an instrument for measuring the value, or the precision of the methods or the machines for constructing the components and/or the systems or manufacturing the components and/or the systems. For example, the approximating language may refer to being within a one, two, four, ten, fifteen, or twenty percent margin in either individual values, range(s) of values and/or endpoints defining range(s) of values.

Here and throughout the specification and claims, range limitations are combined, and interchanged. Such ranges are identified and include all the sub-ranges contained therein unless context or language indicates otherwise. For example, all ranges disclosed herein are inclusive of the endpoints, and the endpoints are independently combinable with each other.

Carbon emissions from the operation of a turbine engine, such as applied in aircraft, negatively impact the atmosphere. Hydrogen is an attractive fuel for low-carbon emissions, but presents challenges as compared to more traditional fuels such as Jet-A. For example, in certain applications, or certain phases of flight, the dangers of hydrogen fuel-burning operation may make a safer, but higher-carbon emitting configuration more attractive, whereas other operational regimes or other phases of flight, where dangers are reduced, may make hydrogen burning more attractive. Additionally, combined fuel operation, where a turbine engine burns both disparate fuels simultaneously, may be desirable in yet other operational regimes or phases of flight.

The present disclosure discussed embodiments of multifuel combustors for dual fuel turbine engines, which permit combustion of disparate fuels in separate zones of a common combustor. Further, the combustor may be reconfigured dependent on operational conditions or turbine engine operating parameters, to allow the engine to operate on one of the two disparate fuels, or both of the disparate fuels. Such turbine engine operating parameters include power thrust output, or emissions output, or any other parameter as may be affected by the configuration of the multifuel combustor.

Referring now to the drawings, FIG. 1 is a schematic cross-sectional diagram of a turbine engine 10, taken along a longitudinal centerline axis 12 of the turbine engine 10, according to an embodiment of the present disclosure. As shown in FIG. 1, the turbine engine 10 defines an axial direction A (extending parallel to the longitudinal centerline axis 12 provided for reference) and a radial direction R that is normal to the axial direction A. In general, the turbine engine 10 includes a fan section 14 and a turbo-engine 16 disposed downstream from the fan section 14.

The turbo-engine 16 includes, in serial flow relationship, a compressor section 21, a combustor 26, and a turbine section 27. The turbo-engine 16 is substantially enclosed within an outer casing 18 that is substantially tubular and defines an annular inlet 20. As schematically shown in FIG. 1, the compressor section 21 includes a booster or a low pressure (LP) compressor 22 followed downstream by a high pressure (HP) compressor 24. The combustor 26 is downstream of the compressor section 21. The turbine section 27 is downstream of the combustor 26 and includes a high pressure (HP) turbine 28 followed downstream by a low pressure (LP) turbine 30. The turbo-engine 16 further includes a jet exhaust nozzle section 32 that is downstream of the turbine section 27, a high-pressure (HP) shaft 34 or a spool, and a low-pressure (LP) shaft 36. The HP shaft 34 drivingly connects the HP turbine 28 to the HP compressor 24. The HP turbine 28 and the HP compressor 24 rotate in unison through the HP shaft 34. The LP shaft 36 drivingly connects the LP turbine 30 to the LP compressor 22. The LP turbine 30 and the LP compressor 22 rotate in unison through the LP shaft 36. The compressor section 21, the combustor 26, the turbine section 27, and the jet exhaust nozzle section 32 together define a core air flow path.

For the embodiment depicted in FIG. 1, the fan section 14 includes a fan 38 (e.g., a variable pitch fan) having a plurality of fan blades 40 coupled to a disk 42 in a spaced apart manner. As depicted in FIG. 1, the fan blades 40 extend outwardly from the disk 42 generally along the radial direction R. In the case of a variable pitch fan, the plurality of fan blades 40 are rotatable relative to the disk 42 about a pitch axis P by virtue of the fan blades 40 being operatively coupled to an actuation member 44 configured to collectively vary the pitch of the fan blades 40 in unison. The fan blades 40, the disk 42, and the actuation member 44 are together rotatable about the longitudinal centerline axis 12 via a fan shaft 45 that is powered by the LP shaft 36 across a power gearbox, also referred to as a gearbox assembly 46. In this way, the fan 38 is drivingly coupled to, and powered by, the turbo-engine 16, and the turbine engine 10 is an indirect drive engine. The gearbox assembly 46 is shown schematically in FIG. 1. The gearbox assembly 46 is a reduction gearbox assembly for adjusting the rotational speed of the fan shaft 45 and the fan 38, relative to the LP shaft 36, when power is transferred from the LP shaft 36 to the fan shaft 45.

Referring still to the exemplary embodiment of FIG. 1, the disk 42 is covered by a fan hub 48 that is aerodynamically contoured to promote an airflow through the plurality of fan blades 40. In addition, the fan section 14 includes an annular fan casing or a nacelle 50 that circumferentially surrounds the fan 38 and at least a portion of the turbo-engine 16. The nacelle 50 is supported relative to the turbo-engine 16 by a plurality of outlet guide vanes 52 that are circumferentially spaced about the nacelle 50 and the turbo-engine 16. Moreover, a downstream section 54 of the nacelle 50 extends over an outer portion of the turbo-engine 16, and, with the outer casing 18, defines a bypass airflow passage 56 therebetween.

During operation of the turbine engine 10, a volume of air 58 enters the turbine engine 10 through an inlet 60 of the nacelle 50 or the fan section 14. As the volume of air 58 passes across the fan blades 40, a first portion of air, also referred to as bypass air 62 is routed into the bypass airflow passage 56, and a second portion of air, also referred to as core air 64, is routed into the upstream section of the core air flow path through the annular inlet 20 of the LP compressor 22. The ratio between the bypass air 62 and the core air 64 is commonly known as a bypass ratio. The pressure of the core air 64 is then increased, generating compressed air 65. The compressed air 65 is routed through the HP compressor 24 and into the combustor 26, where the compressed air 65 is mixed with fuel and ignited to generate combustion gases 66.

The combustion gases 66 are routed into the HP turbine 28 and expanded through the HP turbine 28 where a portion of thermal energy or kinetic energy from the combustion gases 66 is extracted via one or more stages of HP turbine stator vanes 68 and HP turbine rotor blades 70 that are coupled to the HP shaft 34. This causes the HP shaft 34 to rotate, supporting operation of the HP compressor 24 (self-sustaining cycle). In this way, the combustion gases 66 do work on the HP turbine 28. The combustion gases 66 are then routed into the LP turbine 30 and expanded through the LP turbine 30. Here, a second portion of the thermal energy or the kinetic energy is extracted from the combustion gases 66 via one or more stages of LP turbine stator vanes 72 and LP turbine rotor blades 74 that are coupled to the LP shaft 36. This causes the LP shaft 36 to rotate, supporting operation of the LP compressor 22 (self-sustaining cycle) and rotation of the fan 38 via the gearbox assembly 46. In this way, the combustion gases 66 do work on the LP turbine 30.

The combustion gases 66 are subsequently routed through the jet exhaust nozzle section 32 of the turbo-engine 16 to provide propulsive thrust. Simultaneously, the bypass air 62 is routed through the bypass airflow passage 56 before being exhausted from a fan nozzle exhaust section 76 of the turbine engine 10, also providing propulsive thrust. The HP turbine 28, the LP turbine 30, and the jet exhaust nozzle section 32 at least partially define a hot gas path 78 for routing the combustion gases 66 through the turbo-engine 16.

The turbine engine 10 includes a fuel system that provides fuels to the combustor 26. The fuels are pressurized by one or more fuel pressurization devices such as pumps (not shown) causing one or more fuel flows and are mixed with the compressed air 65 from the HP compressor 24 and ignited in the combustor 26 to produce the combustion gases 66. The fuel system may include a fuel tank or a fuel supply for storing the fuel therein, a fuel supply line, and a fuel injector. The fuels are provided from the fuel tanks, along the fuel supply lines to the various fuel injectors and combustion zones, which introduce the fuel into the combustor 26. The fuel system may include one or more flow control devices or valves along the fuel supply lines for controlling amounts of the fuel provided to the combustor 26. The fuel injectors may be provided at a forward end of the combustor 26 and may be provided at intermediate locations of the combustor. Accordingly, fuel provided along the fuel supply lines is provided at a forward end of the combustor 26 and at intermediate locations of the combustor.

The turbine engine 10 depicted in FIG. 1 is by way of example only. In other exemplary embodiments, the turbine engine 10 may have any other suitable configuration. For example, in other exemplary embodiments, the fan 38 may be configured in any other suitable manner (e.g., as a fixed pitch fan) and further may be supported using any other suitable fan frame configuration. The turbine engine 10 may also be a direct drive engine, which does not have a power gearbox. The fan speed is the same as the LP shaft speed for a direct drive engine. Moreover, in other exemplary embodiments, any other suitable number or configuration of compressors, turbines, shafts, or a combination thereof may be provided. In still other exemplary embodiments, aspects of the present disclosure may be incorporated into any other suitable turbine engine, such as, for example, turbofan engines, propfan engines, turbojet engines, turboprop, or turboshaft engines.

Figure 2:
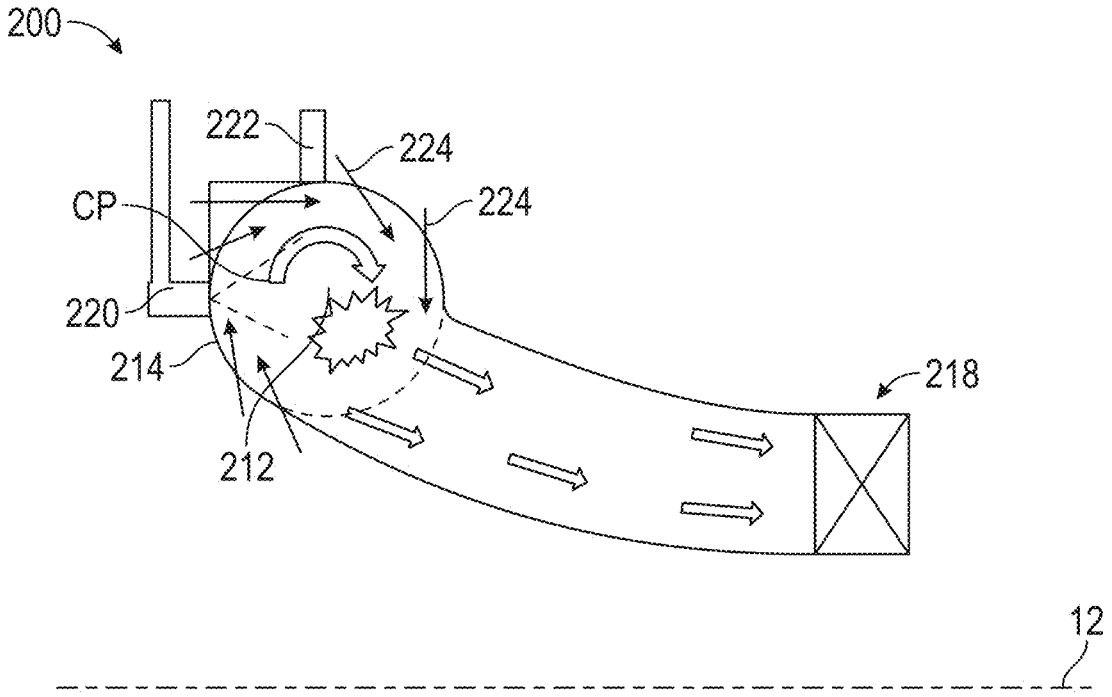
FIG. 2 is a schematic view of a trapped vortex cavity combustor, according to the present disclosure.
Figure 3:
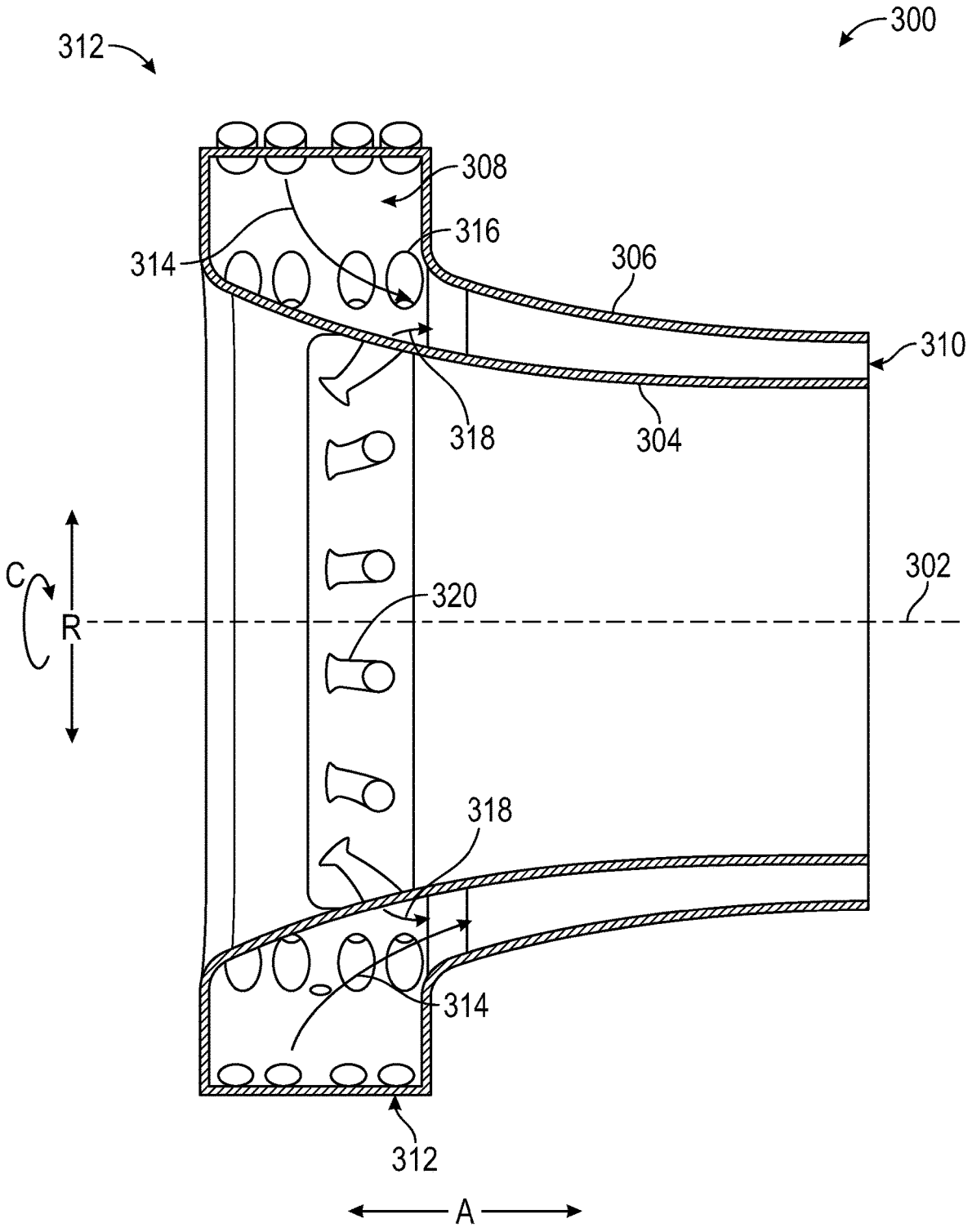
FIG. 3 is a schematic view of a tangential radial inflow combustor, according to the present disclosure.

FIGS. 2 and 3 illustrate exemplary combustors in trapped vortex and tangential-radial inflow configurations, respectively, as employed in the various embodiments of FIGS. 4 to 15.

For example, FIG. 2 illustrates a schematic view of an exemplary trapped vortex (TV) combustor 200 for use in a gas turbine engine 10 (FIG. 1). For example, the TV combustor 200 of FIG. 2 is applied in a similar manner as any combustor, or any combination of combustors, such as, the combustor 26 incorporated in the turbine engine 10 of FIG. 1.

FIG. 2 shows the TV combustor 200, with a TV combustion zone 212 and a combustor exit 218.

In order to simplify the illustration and the description, only the upper half portion of the TV combustor 200 in FIG. 2 is indicated by reference numbers and described specifically. Accordingly, the opposite lower half portion could be understood totally by reference to the illustration and the description of the upper half portion since the TV combustor 200 is substantially symmetric about the longitudinal centerline axis 12 of the gas turbine engine 10 of FIG. 1.

Alternatively, the TV combustor 200 may be single sided. That is, the combustor may not be fully annular, but may instead be an annular section.

The TV combustor 200 comprises an annular combustor that is shaped as generally annular about the longitudinal centerline axis 12 of the turbine engine 10, such that the TV combustion zone 212 is be shaped as annular. The TV combustion zone 212 is formed or shaped as a trapped vortex (TV) combustion cavity in various embodiments. A combustor casing (not shown) may be positioned around the TV combustor 200 for providing support or protection, and the like.

As illustrated in FIG. 2, the upper half portion and the lower half portion of the TV combustion zone 212 each comprises a side wall 214, at least one pilot fuel nozzle 220 disposed on one side end (forward end) of the side wall 214, and an ignitor 222 disposed on a radially outward end of the side wall 214 for igniting. One or more pilot fuel nozzles 220 may be disposed symmetrically about the longitudinal centerline axis 12, such as being disposed circumferentially surrounding the longitudinal centerline axis 12.

As described above, the TV combustion zone 212 may have a substantially circular shape as depicted in FIG. 2. In other exemplary embodiments, the TV combustion zone may be configured as substantially arcuate in shape or substantially rectangular in shape.

The one or more pilot fuel nozzles 220 are operable to inject a fuel (or a reactant) into the TV combustion zone 212. The one or more pilot fuel nozzles 220 may be air-blast nozzle(s), pressure atomizer nozzle(s), plain jet orifice nozzle(s), or any other kinds of nozzles that one skilled in the art could conceive. The fuel comprises a liquid fuel, a gaseous fuel, or a combination of these, which can be selected from the usual fuels, such as jet fuel and any other kinds of fuel that any person skilled in the art could conceive. Air 224 is compressed air from a compressor (not shown) disposed upstream of the TV combustor 200, and the air 224 is directed into the TV combustion zone 212 via a plurality of air apertures (not shown) formed through the side wall 214 along a periphery of the TV combustion zone 212 and flows toroidally and enhances the mixing effect with the fuel.

The fuel and the air 224 are received and mixed in the TV combustion zone 212. The ignitor 222 initiates combustion by a spark to produce combustion products CP flowing toroidally therein.

Although not shown in FIG. 2, further embodiments of the TV combustor 200 include a secondary, tertiary, or more combustion zones disposed downstream of the TV combustion zone 212.

For example, FIG. 3 illustrates a schematic view of an exemplary tangential-radial inflow (TRI) combustor 300 used in a gas turbine engine. For example, the TRI combustor 300 of FIG. 3 is applied in a similar manner as any combustor, or any combination of combustors, such as, the combustor 26 incorporated in the turbine engine 10 of FIG. 1.

FIG. 3 shows the TRI combustor 300 with an inlet assembly 312, a combustor outlet 310, and a combustion chamber 308 therebetween.

The TRI combustor 300 generally defines an axial direction A extending along an axial centerline 302, a radial direction R, and a circumferential direction C (i.e., a direction extending about the axial direction A). The axial centerline 302 may align with a centerline of the turbine engine within which the TRI combustor 300 is installed (e.g., the longitudinal centerline axis 12 of the turbine engine 10 of FIG. 1).

The TRI combustor 300 includes an inner liner 304 and an outer liner 306. The inner liner 304 and the outer liner 306 define the combustion chamber 308 having the combustor outlet 310. The TRI combustor 300 includes the inlet assembly 312 that introduces an airflow 314, such as compressed air, from a compressor section of the turbine engine (in the case of a primary combustor) or an upstream turbine or an upstream turbine stage (in the case of an inter-turbine combustor or an inter-stage combustor) into the combustion chamber 308. The inlet assembly 312 introduces the airflow 314 in a manner such that the airflow 314 has a desired swirl.

In addition, the inner liner 304 includes a plurality of dilution holes 316 to provide a dilution airflow 318 to the combustion chamber 308. The exemplary dilution holes 316 are configured such that the dilution airflow 318 discharged therefrom flows helically relative to the axial centerline 302 of the TRI combustor 300, such that an angular momentum of the airflow 314 is maintained when the dilution airflow 318 mixes with the airflow 314. Each dilution hole 316 may include a chute 320 to facilitate channeling airflow from a source (not shown) through the dilution holes 316.

In the TRI combustor 300, the inner liner 304 and the outer liner 306 are convex relative to the axial centerline 302 of the TRI combustor 300 such that the combustion chamber 308 is defined at a radially outermost region of the TRI combustor 300. To facilitate inducing bulk swirl in the airflow 314, the inlet assemblies 312 are oriented to discharge the airflow 314 circumferentially and radially into the combustion chamber 308.

Figure 4:
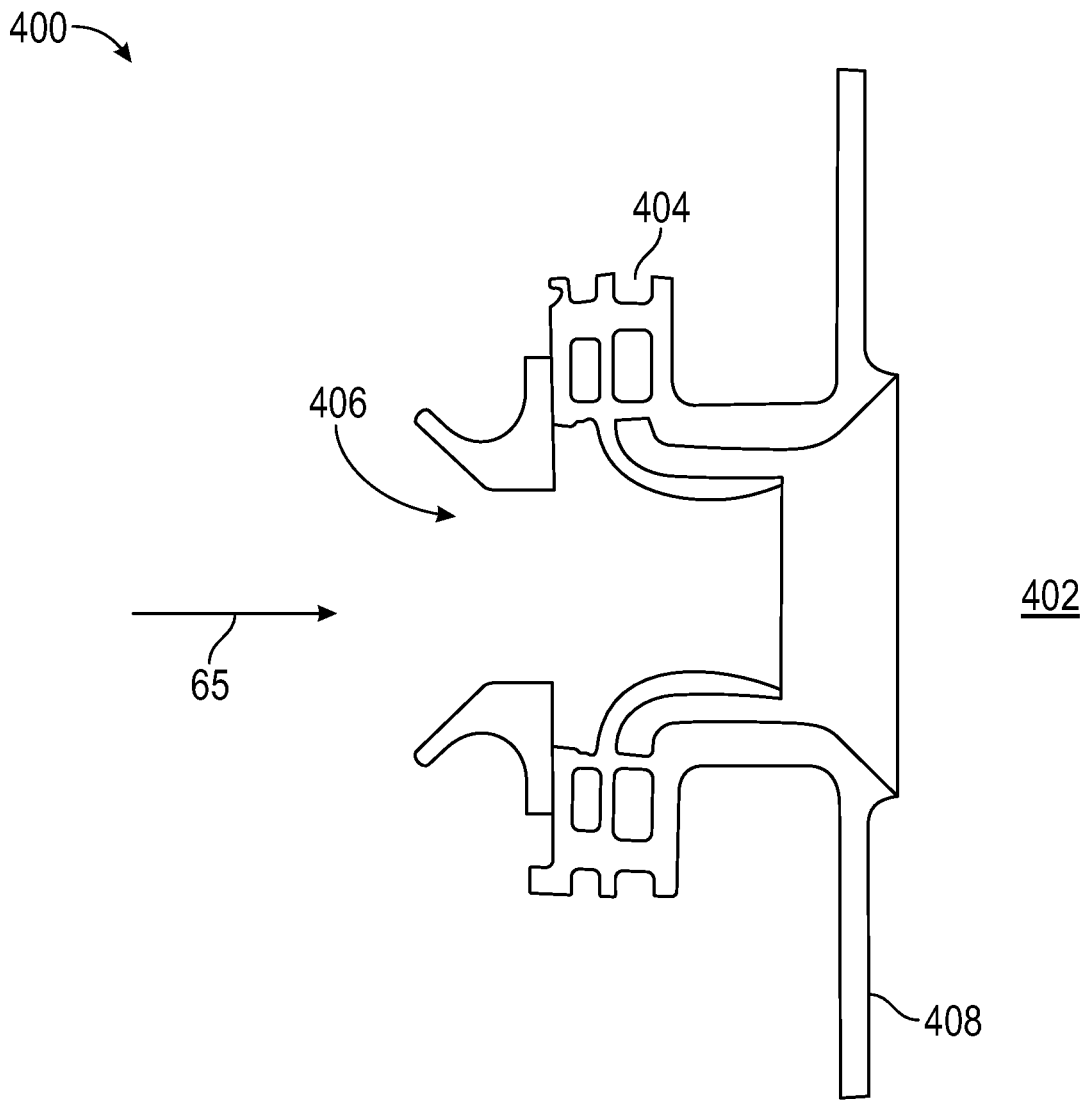
FIG. 4 is a schematic view of a swirl cup mixer assembly, according to the present disclosure.
Figure 5:
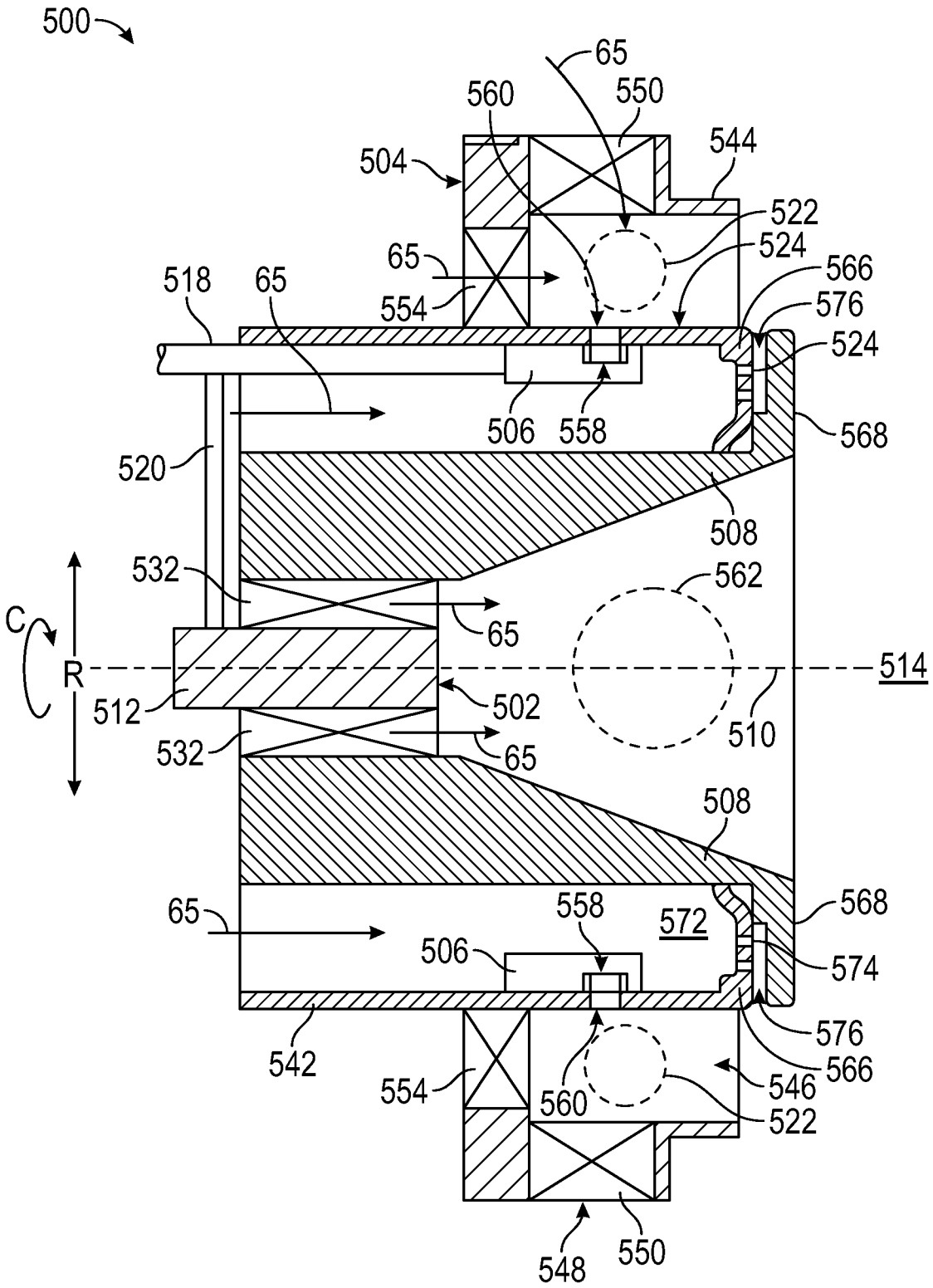
FIG. 5 is a schematic view of a twin annular premixing swirler assembly, according to the present disclosure.

FIGS. 4 and 5 illustrate schematic views of mixers. Specifically, an exemplary swirl cup mixer assembly 400 and an exemplary twin annular premixing swirler (TAPS), also referred to as a TAPS mixer assembly 500, are shown, respectively, as may be employed in the embodiments of the combustors shown in FIGS. 6 to 13. The swirl cup mixer assembly 400 and the TAPS mixer assembly 500 receive and mix a supply of fuel and the compressed air 65, generating a mixture the fuel and the compressed air 65, and introduce the mixture of the fuel and the compressed air 65 to the respective combustor in which the mixer is employed.

Referring now to FIG. 4, the swirl cup mixer assembly 400 is shown, as may be employed in the combustor 26 of FIG. 1. The combustor 26 may include one or more swirl cup mixer assemblies 400 for introducing the air/fuel mixture into a combustion chamber 402. Notably, the compressed air 65 may be directed from the HP compressor 24 (FIG. 1) into or through one or more swirl cup mixers 404 to support combustion in an upstream end of the combustion chamber 402.

A liquid and/or gaseous fuel is transported to the combustor 26 by a fuel distribution system (not shown), where the fuel is introduced at a front end of the combustor 26 in a highly atomized spray from a fuel nozzle. In an exemplary embodiment, each swirl cup mixer assembly 400 defines a fuel opening 406 for receiving the fuel. The fuel opening 406 permits the fuel to enter the swirl cup mixer assembly 400 in an axial direction (i.e., generally parallel to the longitudinal centerline axis 12 as shown in FIG. 1) as well as in a generally radial direction, where the fuel is swirled with the incoming compressed air. Thus, each swirl cup mixer 404 receives compressed air and fuel. The compressed air and fuel are swirled and mixed together by swirl cup mixers 404, and the resulting fuel/air mixture is discharged into the combustion chamber 402 for combustion thereof.

Referring still to FIG. 4, the plurality of swirl cup mixers 404 are placed circumferentially within the combustor 26, around the engine 10. The fuel opening 406 in each swirl cup mixer 404 provides fuel, supporting the combustion process. Each swirl cup mixer assembly 400 has a heat shield, for example, a deflector assembly 408, which thermally insulates the upstream end of the combustor 26 from extremely high temperatures generated in the combustion chamber 402 during engine operation.

FIG. 5 is an enlarged partial cross-sectional view of the twin annular premixing swirler (TAPS) fuel nozzle-mixer assembly 500, also referred to as a fuel nozzle-mixer assembly 500, according to the present disclosure. The fuel nozzle-mixer assembly 500 includes a pilot mixer 502, a main mixer 504, and a fuel manifold 506 positioned therebetween. The pilot mixer 502 includes an annular venturi 508 that extends circumferentially about a combustor longitudinal centerline axis 510, and a pilot fuel injector 512 mounted within the venturi 508. Further, the pilot mixer 502 includes a pilot swirler 532 that constitutes a plurality of swirl vanes arranged radially outward of the pilot fuel injector 512. The pilot swirler 532 is generally oriented parallel to the combustor longitudinal centerline axis 510, and includes a plurality of vanes for swirling air traveling therethrough. Fuel and air are generally provided to the pilot mixer 502 at all times during the engine operating cycle.

The pilot fuel injector 512 may perform pre-filming and atomization of fuel almost exclusively by blasting air at the fuel. Fuel is provided by a fuel tube 518 in flow communication with a fuel source (not shown) to a conduit 520 connected with the pilot fuel injector 512. The fuel is injected from the pilot fuel injector 512 into the venturi 508. A pilot fuel-oxidizer mixture 562 is then generated within the venturi 508 by mixing the swirling compressed air 65 passing through the pilot mixer 502 and the fuel injected by the pilot fuel injector 512. The pilot fuel-oxidizer mixture 562 is then injected into a combustion chamber 514, where the pilot fuel-oxidizer mixture 562 is ignited and burned to generate the combustion gases 66 (FIG. 1).

The main mixer 504 is attached to a centerbody outer shell 542 that surrounds the pilot mixer 502. The main mixer 504 includes an annular main housing 544 radially surrounding the centerbody outer shell 542, where the main housing 544 defines an annular cavity 546 and a main swirler 548. The main swirler 548 includes a first swirler 550 that is oriented substantially radially to the combustor longitudinal centerline axis 510, and includes a plurality of vanes (shown generally) for swirling the compressed air 65 flowing therebetween. The vanes are substantially uniformly spaced circumferentially, and a plurality of substantially uniform passages are defined between adjacent vanes. The main swirler 548 also includes a second swirler 554 oriented substantially parallel to the combustor longitudinal centerline axis 510. The second swirler 554 further includes a plurality of vanes (shown generally) for swirling the compressed air 65 flowing therebetween. The vanes of the second swirler 554 are substantially uniformly spaced circumferentially, defining a plurality of substantially uniform passages therebetween.

The fuel manifold 506, as stated above, is located between the pilot mixer 502 and the main mixer 504, and is in flow communication with a fuel supply (not shown). A plurality of main fuel injectors 558 are provided at the fuel manifold 506, and the centerbody outer shell 542 includes a plurality of main fuel injector orifices 560 therethrough. The main fuel injectors 558 are arranged to inject fuel through the main fuel injector orifices 560 and into the annular cavity 546 of the main mixer 504. As shown in FIG. 5, the main fuel injectors 558 are preferably positioned so that fuel is provided into the annular cavity 546 downstream of the first swirler 550 and downstream of the second swirler 554. A main fuel-oxidizer mixture 522 is generated within the annular cavity 546 by mixing of the compressed air 65 passing through the first swirler 550 and through the second swirler 554 with the fuel injected by the main fuel injectors 558 into the annular cavity 546. The main fuel-oxidizer mixture 522 then flows into the combustion chamber 514, where the main fuel-oxidizer mixture 522 is ignited and burned to generate the combustion gases 66 (FIG. 1).

Referring still to FIG. 5, a backplate 566 is integrally formed with the centerbody outer shell 542 at a downstream end 524 of the centerbody outer shell 542, and the backplate 566 is connected to the venturi 508. A heat shield 568 is integrally formed with the fuel nozzle-mixer assembly 500 at a downstream side of the backplate 566. The heat shield 568 thermally protects adjacent components of the fuel nozzle-mixer assembly 500 such as the centerbody outer shell 542 and the fuel manifold 506 from heat generated in the combustion chamber 514 and may be constructed from a ceramic matrix composite (CMC) or similar thermally insulating material.

The venturi 508, the centerbody outer shell 542, and the backplate 566 define a generally annular cooling air flow cavity 572. The compressed air 65 flows through the cooling air flow cavity 572, and exits the cooling air flow cavity 572 through one or more cooling air exit holes 574 in the backplate 566. The cooling air exit holes 574 permit the compressed air 65 to exit the cooling air flow cavity 572, maintaining the air 65 in a continuous flow through the cooling air flow cavity 572. The compressed air 65 exits the cooling air flow cavity 572, via the cooling air exit holes 574, first, into a cooling air flow gap 576 arranged circumferentially about the combustor longitudinal centerline axis 510, and axially between the backplate 566 and the heat shield 568. The compressed air 65 flows through and exits the cooling air flow gap 576 in a generally radially outward direction, whereupon the compressed air 65 merges with the flow of the main fuel-oxidizer mixture 522. The main fuel-oxidizer mixture 522, flowing in a generally axially downstream direction, lends a downstream component to the flow direction of the compressed air 65, after exiting the cooling air flow gap 576.

FIGS. 6 to 15 show various embodiments and aspects of combustors configured to combust two disparate fuels. Disparate fuels and their corresponding fuel and air mixtures have different residence time requirements within a combustor. A fuel and its corresponding fuel and air mixture with a longer residence time generally requires a larger combustion zone than a fuel or a fuel and air mixture with a shorter residence time, in an otherwise equivalent combustor. A combustor in a turbine engine that combusts two or more disparate fuels may have multiple combustion zones, each corresponding to one of the disparate fuels, and each of the multiple combustion zones having a unique size and a shape optimized for its respective fuel. Additionally or alternatively, a combustor in a turbine engine that combusts two or more disparate fuels may have variable combustion zones, capable of changing size and/or shape, to optimize the combustion zone for the one of the disparate fuels being combusted at a given time.

Examples of fuels with longer residence times, as used in a turbine engine such as the turbine engine 10 of FIG. 1 include Jet-A fuel and sustainable aviation fuel (SAF). An example of a fuel with a shorter residence time, as used in a turbine engine such as the turbine engine 10 of FIG. 1 is diatomic hydrogen gas ($H_2$). These fuels are examples only, and the following descriptions are not exclusive to these fuels. On the contrary, as will be discussed, the various embodiments of combustors with relatively sized combustion zones may be applied to any grouping of disparate fuels currently known, or as may be developed or discovered in the future. Hereafter, for the sake or convenience, the term "Jet-A" generally applies to any longer residence time fuel in a grouping of disparate fuels. Similarly, the term "hydrogen" generally applies to any shorter residence time fuel in a grouping of disparate fuels.

Figure 6:
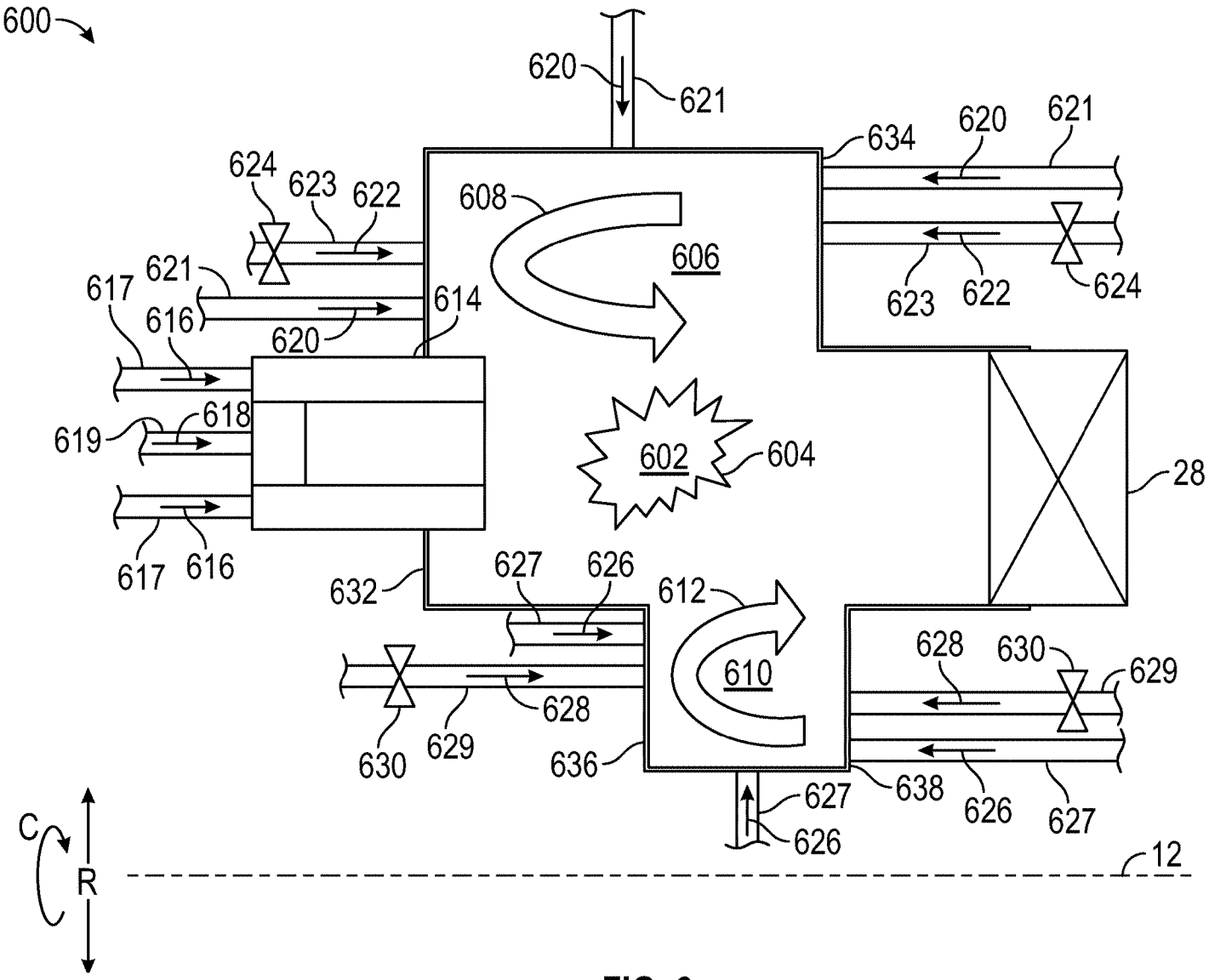
FIG. 6 is a schematic view of an embodiment of a multifuel combustor, according to the present disclosure.

Referring now specifically to FIG. 6, a multifuel combustor 600 has a main combustion zone 602 for combusting a Jet-A and air mixture 604, a Jet-A TV combustion zone 606 for combusting a Jet-A and air mixture 608, and a hydrogen TV combustion zone 610 for combusting a hydrogen and air mixture 612.

An injector-mixer 614 receives one or more flows of Jet-A 616 (two shown) through one or more corresponding Jet-A inlets 617 and one or more flows of air 618 (one shown) through one or more air inlets 619, mixes the one or more flows of Jet-A 616 and the one or more flows of air 618 into the Jet-A and air mixture 604, and injects the Jet-A and air mixture 604 into the main combustion zone 602 via the injector-mixer 614. The injector-mixer 614 may be a swirl cup mixer assembly 400, as shown in FIG. 4, or may be a TAPS mixer assembly 500 as shown in FIG. 5, for example. The injector-mixer 614 may alternatively be any other configuration of injector-mixer capable of mixing the one or more flows of Jet-A 616 and the one or more flows of air 618 into the Jet-A and air mixture 604 and injecting the Jet-A and air mixture 604 into the main combustion zone 602. Within the main combustion zone 602, the Jet-A and air mixture 604 may have a swirling flow shape, imparted by the injector-mixer 614, but moves in a prevailingly downstream direction, toward the HP turbine 28, with respect to the longitudinal centerline axis 12.

The time that each of the Jet-A and air mixture 604 and the Jet-A and air mixture 608 spends in its respective main combustion zone 602 or Jet-A TV combustion zone 606 may be approximated by the axial length of the respective main combustion zone 602 or Jet-A TV combustion zone 606, as the prevailing flow direction is axial with respect to the longitudinal centerline axis. The main combustion zone 602 and the Jet-A TV combustion zone 606 are similarly sized in the axial direction, as both zones combust the similar Jet-A and air mixture 604 and Jet-A and air mixture 608, with similar residence times.

Conversely, the hydrogen TV combustion zone 610 is substantially axially smaller than the Jet-A TV combustion zone 606. As the residence time of hydrogen is shorter than that of Jet-A, the time required for the hydrogen and air mixture 612 to combust in the hydrogen TV combustion zone 610 is much shorter than the time required for the Jet-A and air mixture 608 to combust in the Jet-A TV combustion zone 606. Likewise, the hydrogen TV combustion zone 610 is located biased in the axially downstream direction as compared to the main combustion zone 602 and the Jet-A TV combustion zone 606. The smaller size and the relatively downstream position of the hydrogen TV combustion zone 610 are due to the hydrogen fuel having a shorter residence time requirement, dictating less total time required in the combustor.

As seen in the aspect of FIG. 6, one or more Jet-A inlets 621 and one or more air inlets 623 are in fluid communication with the Jet-A TV combustion zone 606, and provide one or more flows of Jet-A 620 and one or more flows of air 622 to the Jet-A TV combustion zone 606, respectively. The flows of Jet-A 620 enter the Jet-A TV combustion zone 606 in an asymmetric orientation. One flow of Jet-A 620 injects into the Jet-A TV combustion zone 606 through a forward wall 632 near the radially outboard edge of the Jet-A TV combustion zone 606, with respect to the longitudinal centerline axis 12, whereas another flow of Jet-A 620 injects into the Jet-A TV combustion zone 606 through an aft wall 634 near the radially inboard edge of the Jet-A TV combustion zone 606. Still another flow of Jet-A is injected into the Jet-A TV combustion zone 606 in a substantially radial direction with respect to the longitudinal centerline axis 12. Converse to the flows of Jet-A 620, the flows of air 622 are injected into the Jet-A TV combustion zone 606 through the forward wall 632 and the aft wall 634, biased toward the outboard and inboard, respectively. Because the cumulative mass flow rate of the flow of Jet-A 620 is a greater mass flow than the mass flow rate of the flows of air 622, and due to the asymmetric arrangement of the flows of Jet-A 620 injected into the Jet-A TV combustion zone 606, the Jet-A and air mixture has a circular flow pattern, or a vortex flow pattern in the Jet-A TV combustion zone 606. The vortex flow direction is such that the Jet-A and air mixture 608 flows inward (toward the longitudinal centerline axis 12), against the forward wall 632, whereupon intersecting with the flows of Jet-A 616 and flow of air 618 exiting the injector-mixer 614, the combined flow is turned and proceeds in an axially aft, downstream direction, with respect to the longitudinal centerline axis 12. The flows of air 622 are controlled via control valves 624, increasing or decreasing the respective air flow rates of the flows of air 622 in the Jet-A and air mixture 608 in the Jet-A TV combustion zone 606. Combustion of the Jet-A and air mixture 608 takes place throughout the duration of the multifuel combustor 600, including both in the Jet-A TV combustion zone 606 and, after mixing with the Jet-A and air mixture 604, in the main combustion zone 602.

One or more hydrogen inlets 627 and one or more air inlets 629 are in fluid communication with the hydrogen TV combustion zone 610, and provide one or more flows of hydrogen 626 and one or more flows of air 628 to the hydrogen TV combustion zone 610, respectively. The flows of hydrogen 626 enter the hydrogen TV combustion zone 610 through a forward wall 636 at a relatively radially inboard location, through an aft wall 638 at a relatively radially outboard location and in the radially inward direction. The net of the flows of hydrogen imparts a circular flow pattern, or a vortex flow pattern into the hydrogen and air mixture 612 that enters the main combustion zone 602, flowing in a radially inward direction against the forward wall, whereupon the hydrogen and air mixture 612 intersects with the combination of the Jet-A and air mixture 604 and the Jet-A and air mixture 608, turning the flow in a downstream, aft direction with respect to the longitudinal centerline axis 12. The flows of air 628 enter the hydrogen TV combustion zone 610 through the forward wall 636 and the aft wall 638, mixing with the flows of hydrogen 626, generating the hydrogen and air mixture 612. Combustion of the hydrogen and air mixture 612 takes place both in the hydrogen TV combustion zone 610 and, after mixing with the Jet-A and air mixture 604, in the main combustion zone 602. As hydrogen and its corresponding hydrogen and air mixture 612 have a lower residence time requirement, the hydrogen TV combustion zone 610 may be smaller than the Jet-A TV combustion zone 606 and may be located axially aft in comparison spending less time, overall, in the multifuel combustor 600.

The multifuel combustor 600 is operationally flexible in that the flows of Jet-A 620 and the flows of hydrogen 626 may be alternatively switched off, deactivating the Jet-A TV combustion zone 606 and the hydrogen TV combustion zone 610, respectively, during different operational conditions. Such operational conditions may be dictated by different power requirements, safety concerns, fuel availability, or the like. For example, in an aircraft application, use of hydrogen in ground operations, may be undesirable due to the volatility and explosive properties of hydrogen. As another example, using both the Jet-A TV combustion zone 606 and the hydrogen TV combustion zone 610 simultaneously may be called for during operational conditions with high power requirements, such as takeoff or climb. In such high-power requirement conditions, the flows of Jet-A 620 and the flows of hydrogen 626 may all be activated, resulting in the highest overall power output of the turbine engine 10 (FIG.

1). Lastly, in low-power requirement conditions such as descent, both the flows of Jet-A 620 to the Jet-A TV combustion zone 606 and the flows of hydrogen 626 to the hydrogen TV combustion zone 610 may be switched off, the turbine engine 10 then operating only with the power generated by the Jet-A and air mixture 604 combusting in the main combustion zone 602. Still other conditions are contemplated where the hydrogen TV combustion zone 610 operates, but the Jet-A TV combustion zone 606 does not operate.

The rates of the flows of air 622 and 628 are controlled by the control valves 624 and the control valves 630, respectively. In order to maintain proper shape and mixture of net flows in the main combustion zone 602 during various flight conditions that might require different combinations of operational combustion zones, the rates of the flows of air 622 and 628 can be adjusted to maintain stable operation. For example, when fewer than all three of the main combustion zone 602, the Jet-A TV combustion zone 606 and the hydrogen TV combustion zone 610 are operational, such as when the hydrogen TV combustion zone 610 is not operational, the flow of air 628 is reduced to prevent a blowout condition. Blowout is defined as a state in which the multifuel combustor 600 can no longer sustain combustion. Blowout can be caused by a too-lean operational condition, which may occur if the flow of hydrogen 626 is shut off to the hydrogen TV combustion zone 610, but the flow of air 628 is maintained at the same air flow rate as when the hydrogen TV combustion zone 610 is operating. To prevent blowout in such circumstances, the flow of air 628 is maintained at a reduced but non-zero value however, to maintain adequate cooling of the multifuel combustor 600, for example, in the hydrogen TV combustion zone 610. A similar operation may occur, where the rate of the flow of air 622 is maintained at a reduced volume in the Jet-A TV combustion zone 606 when the Jet-A TV combustion zone is not operating. Finally, in an operational state of the turbine engine 10 in which neither the Jet-A TV combustion zone 606 nor the hydrogen TV combustion zone is operating, reduced non-zero rates of the flow of air 628 and the flow of air 622 are maintained, respectively.

Figure 7:
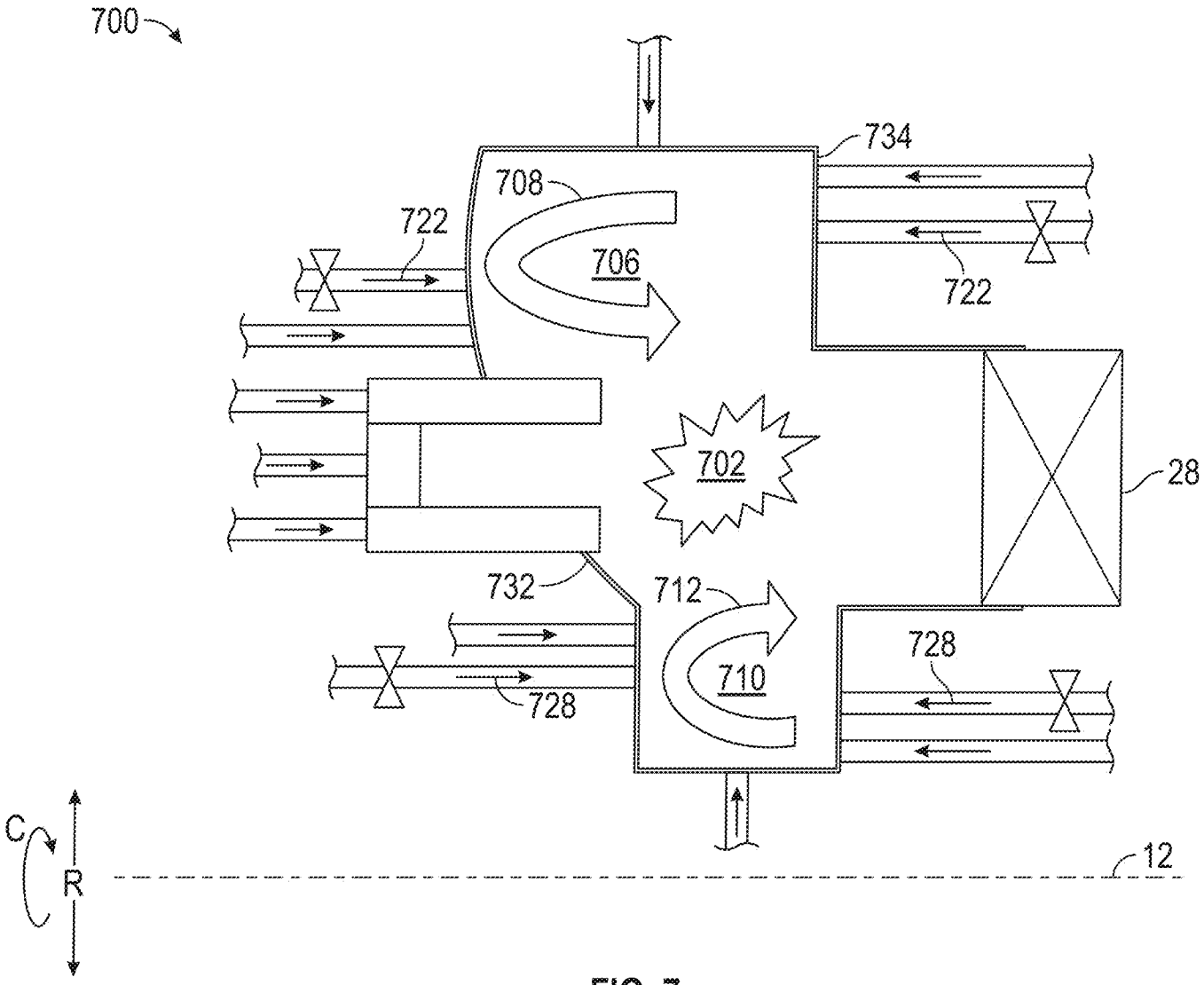
FIG. 7 is a schematic view of an embodiment of a multifuel combustor, according to the present disclosure.

FIG. 7 illustrates a multifuel combustor 700, similar in function to the multifuel combustor 600 of FIG. 6. The multifuel combustor 700, however, has a curved forward wall 732. The curved forward wall 732 is curved axially aft, in the radially inward direction with respect to the longitudinal centerline axis 12. Upon contacting the curved forward wall 732, a Jet-A and air mixture 708 is guided not only radially inward, toward a main combustion zone 702, but additionally aft, toward a hydrogen TV combustion zone 710. In this aspect, the curved forward wall 732 better mixes the Jet-A and air mixture 708 into the hydrogen TV combustion zone 710 when a Jet-A TV combustion zone 706 is operating, and better mixes a flow of air 722 into the hydrogen TV combustion zone 710 when the Jet-A TV combustion zone 706 is not operating. This allows a portion of the flow of air 722 to be mixed and combusted in a hydrogen and air mixture 712, further allowing an overall flow of air 728 to be reduced, while both maintaining adequate cooling in the Jet-A TV combustion zone 706 and maintaining a sufficient ratio in the hydrogen and air mixture 712 in the hydrogen TV combustion zone. A fuel-lean blowout condition may occur if the separate flows of air 722 and 728 are maintained for both cooling the Jet-A TV combustion zone 706 and maintaining the adequate hydrogen and air mixture 712 in the hydrogen TV combustion zone 710. The curved forward wall 732, by guiding the mixing of the flow of air 722 into the hydrogen TV combustion zone 710 prevents such a condition.

Several features of FIG. 7 are shown and labeled with reference numerals, but not explicitly described herein. Elements of FIG. 7 with reference numerals in the 700-series, but not described above, are identical to those corresponding elements in FIG. 6, with otherwise identical reference numerals in the 600-series.

Figure 8:
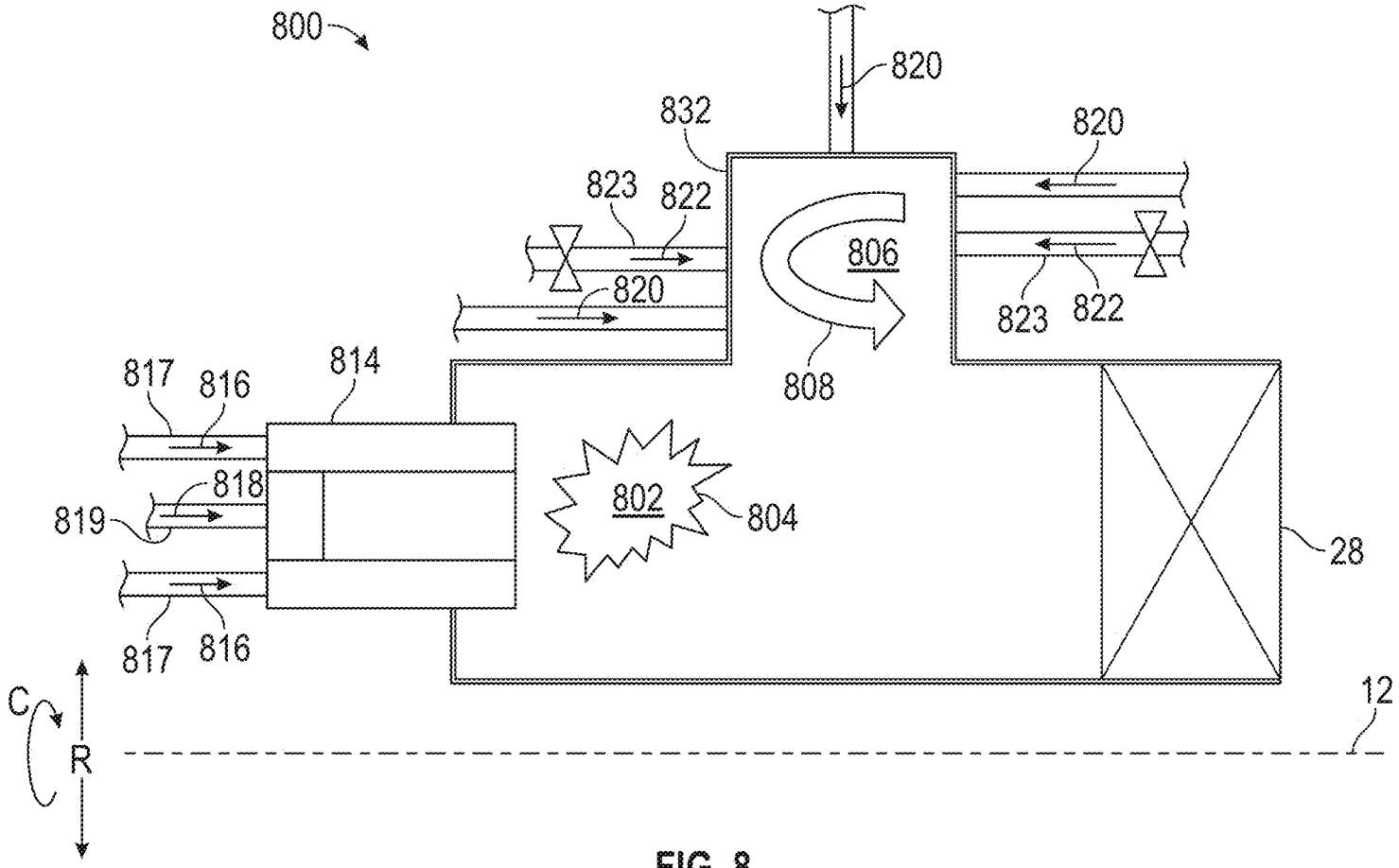
FIG. 8 is a schematic view of an embodiment of a multifuel combustor, according to the present disclosure.

FIG. 8 illustrates a multifuel combustor 800 a main combustion zone 802 and, downstream, a secondary combustion zone that is a trapped vortex combustion zone 806. The main combustion zone 802, similar to the main combustion zone 602 and the main combustion zone 702, is served by a main injector-mixer assembly 814 that may be a swirl cup mixer assembly 400 as shown in FIG. 4, for example, a TAPS mixer assembly 500 as shown in FIG. 5, for example, or any other configuration of injector-mixer capable of receiving one or more flows of main fuel 816 through one or more main fuel inlets 817 and one or more flows of main air 818 through one or more main air inlets 819, and injecting a main fuel and air mixture 804 into the main combustion zone 802.

The trapped vortex combustion zone 806 is downstream and radially outboard of the main combustion zone 802, with respect to the longitudinal centerline axis 12. The trapped vortex combustion zone 806 receives one or more flows of secondary fuel 820 through one or more secondary fuel inlets 821 and one or more flows of secondary air 822 through one or more secondary air inlets 823 in an asymmetric configuration to induce a circular or a vortex shaped flow of a secondary fuel and air mixture 808, flowing radially inward, against a forward wall 832. Alternatively, the trapped vortex combustion zone 806 may be located radially inboard of the main combustion zone 802, in which case, the flow pattern of the secondary fuel and air mixture 808 would be arranged to flow radially outward, against the forward wall 832 of the trapped vortex combustion zone 806.

In the multifuel combustor 800, the one or more flows of main fuel 816 are preferably a relatively high residence time fuel such as Jet-A, and the flows of secondary fuel 820 are preferably a relatively low residence time fuel, such as hydrogen. Alternatively, the main fuel may be hydrogen, or a similarly low residence time fuel, and the secondary fuel may be Jet-A, or a similarly high residence time fuel. When the main fuel is of a relatively high residence time, as is shown in FIG. 8, the longer path of travel through the multifuel combustor 800 for the main fuel and air mixture 804, and, consequently, the greater time in the multifuel combustor 800, relative to the path of travel and the time in the multifuel combustor 800 for the secondary fuel and air mixture 808, allows for each of the main fuel and air mixture 804 and the secondary fuel and air mixture 808 to each achieve complete burn immediately prior to exiting the main combustion zone 802, and into the HP turbine 28. The flows of secondary air 822 are reduced to a lesser, non-zero air flow rate to maintain adequate cooling while not risking blowout, if the secondary, trapped vortex combustion zone 806 is not operating due to an engine control parameter, as previously discussed.

Several features of FIG. 8 are shown and labeled with reference numerals, but not explicitly described herein. Elements of FIG. 8 with reference numerals in the 800-series, but not described above, are identical to those corresponding elements in FIG. 6, with otherwise identical reference numerals in the 600-series.

Figure 9:
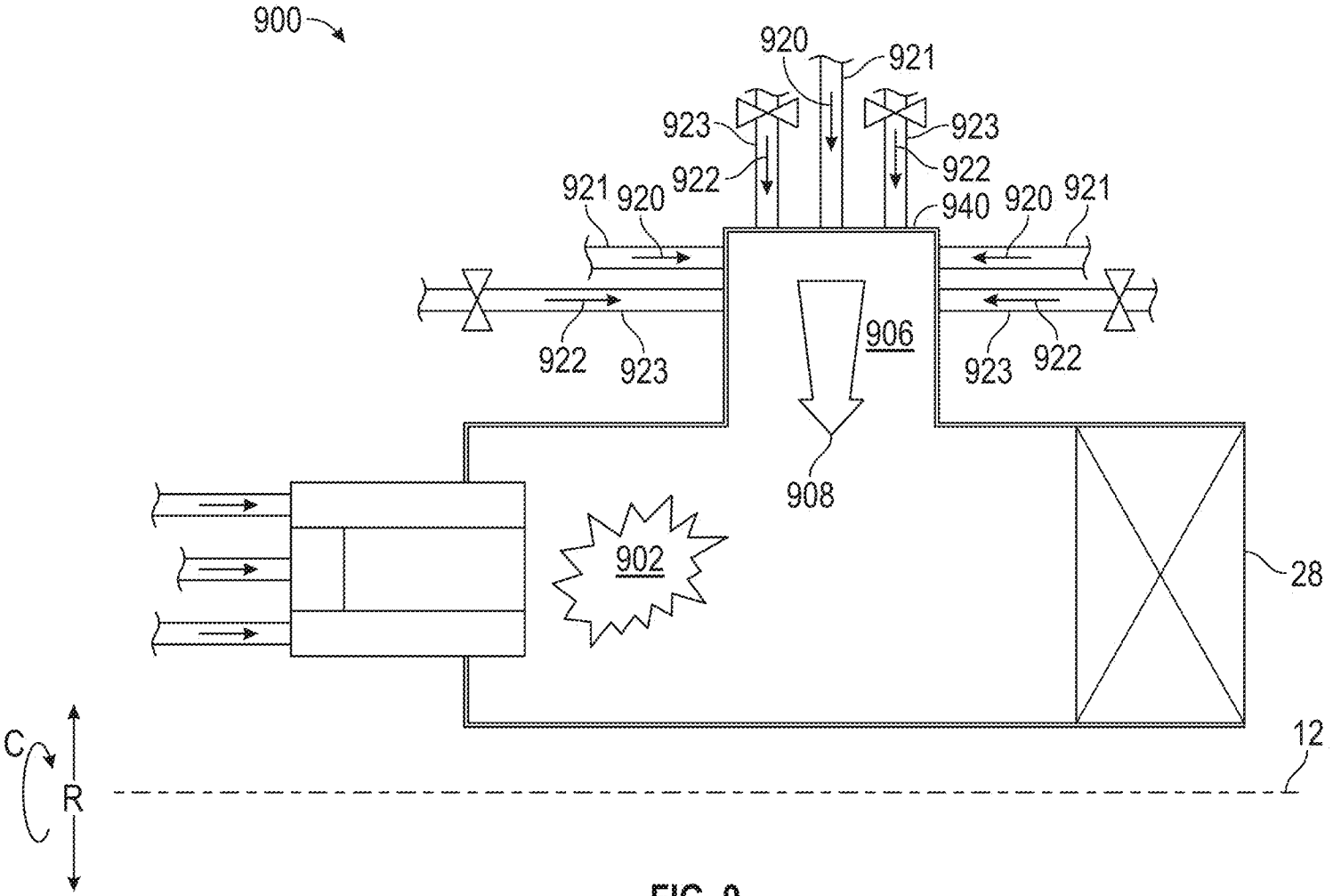
FIG. 9 is a schematic view of an embodiment of a multifuel combustor, according to the present disclosure.

FIG. 9 illustrates a multifuel combustor 900 having a main combustion zone 902 and being similar in arrangement to the multifuel combustor 800, but wherein the secondary combustion zone is a TRI combustion zone 906. In the TRI combustion zone 906, a flow of secondary fuel 920 is received through a secondary fuel inlet 921 disposed in a radially outside wall 940. Similarly, an air inlet 923 disposed in the radially outside wall 940, provides a flow of secondary air 922 to the TRI combustion zone 906. One or more flows of secondary fuel 920 and one or more flows of secondary air 922 may also be injected into the TRI combustion zone from the forward or aft direction, as well. Together, the flow of secondary fuel 920 and the flow of secondary air 922 induce a radially inward flowing secondary fuel and air mixture 908, similar to that described with respect to the TRI combustor 300 of FIG. 3. In the multifuel combustor 900 with a TRI combustion zone, the orientation of the angle of injection of the secondary fuel is established in a way so as to optimize the residence time of the secondary fuel in the multifuel combustor 900, as will be discussed in greater below in the discussion to follow.

Several features of FIG. 9 are shown and labeled with reference numerals, but not explicitly described herein. Elements of FIG. 9 with reference numerals in the 900-series, but not described above, are identical to those corresponding elements in FIG. 8, with otherwise identical reference numerals in the 800-series.

Figure 10A:
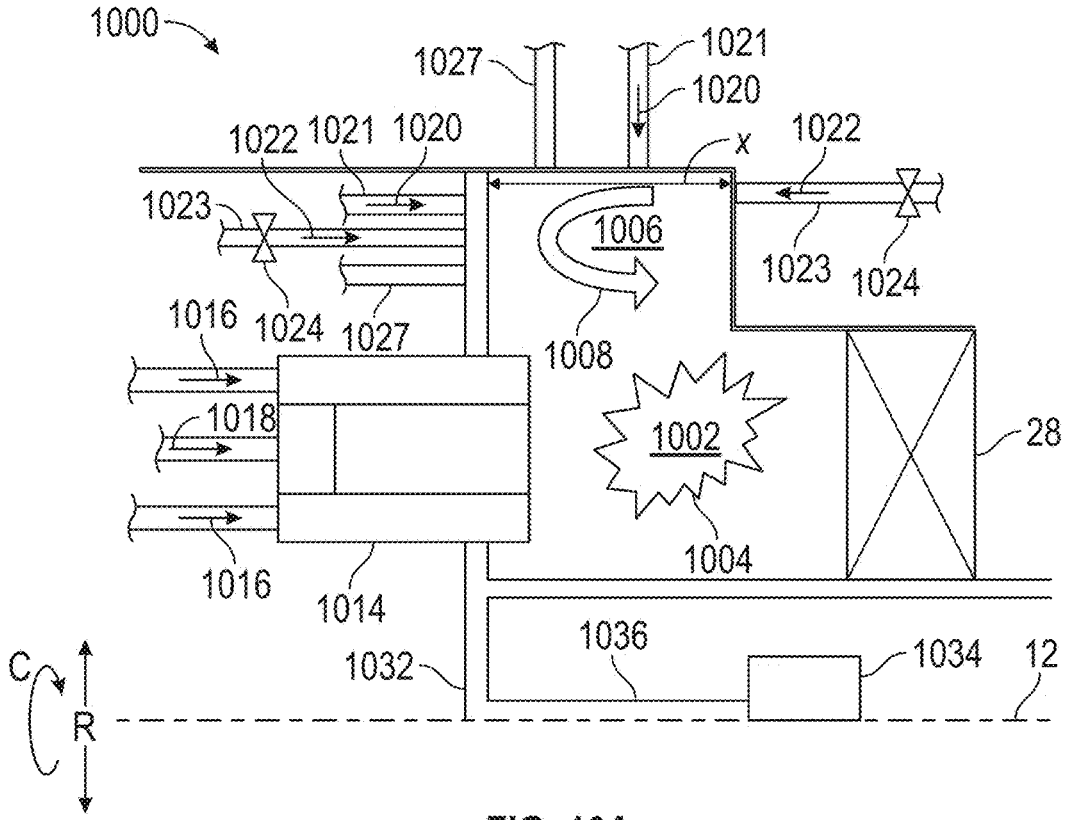
FIG. 10A is a schematic view of an embodiment of a reconfigurable multifuel combustor in a first configuration, according to the present disclosure.
Figure 10B:
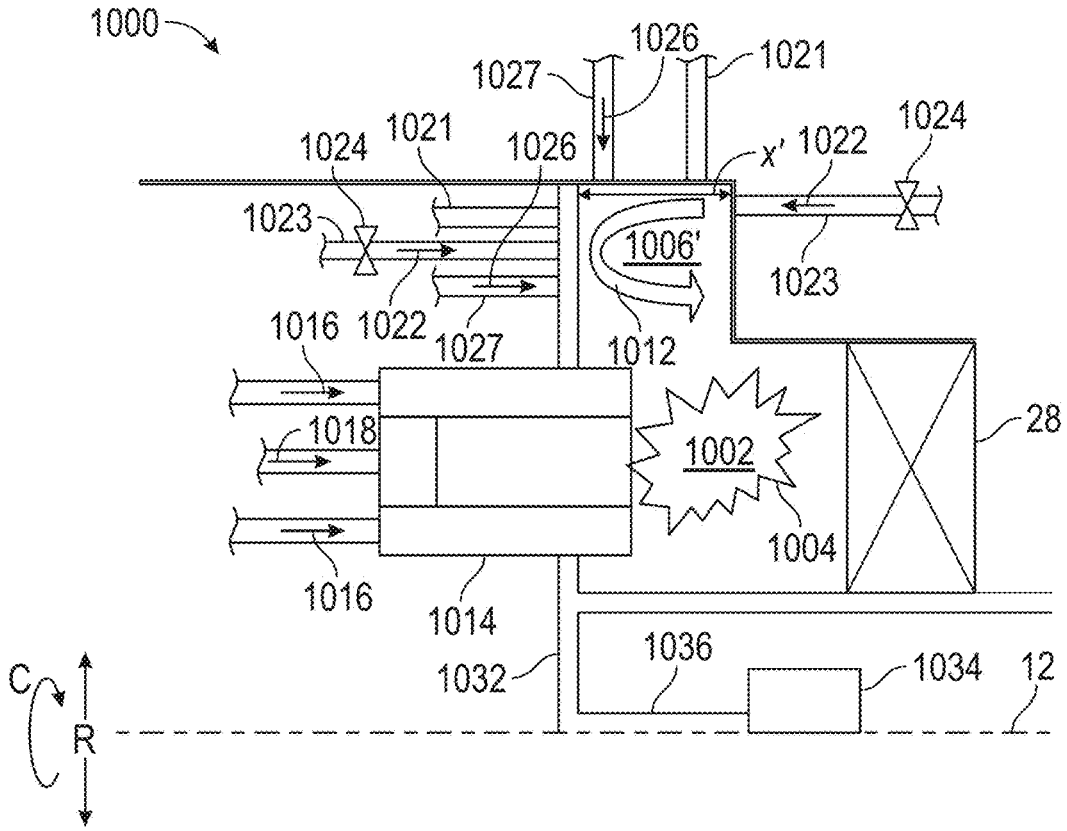
FIG. 10B is a schematic view of an embodiment of a reconfigurable multifuel combustor in a second configuration, according to the present disclosure.

FIGS. 10A and 10B illustrate different schematic configurations of a reconfigurable multifuel combustor 1000. In the reconfigurable multifuel combustor 1000, a main combustion zone 1002 receives a main fuel and air mixture 1004 for combustion, and a secondary, TV combustion zone receives a secondary fuel and air mixture for combustion. In the configuration of FIG. 10A, also referred to as the Jet-A TV configuration, the reconfigurable multifuel combustor 1000 operates with a higher residence time fuel in the TV combustion zone, configured as a Jet-A TV combustion zone 1006 with an axial length of x. In the Jet-A TV combustion zone 1006, one or more flows of Jet-A 1020 are received through one or more Jet-A inlets 1021, and one or more flows of air 1022 enter the Jet-A combustion zone through one or more air inlets 1023 in an asymmetric configuration to form a Jet-A and air mixture 1008, flowing in a circular or a vortex shape, such that the Jet-A and air mixture 1008 flows radially toward the main combustion zone 1002, against an axially movable forward wall 1032, eventually intersecting with a flow of main fuel 1016 and a flow of main air 1018. In the Jet-A configuration, the Jet-A TV combustion zone 1006 is relatively larger, to accommodate the relatively longer residence time of the Jet-A fuel.

In the reconfigurable multifuel combustor 1000, an injector-mixer 1014 is disposed within the movable forward wall 1032, such that the injector mixer 1014 moves axially forward and aft as the movable forward wall 1032 moves forward and aft. Consequently, the location of the main combustion zone 1002 moves forward and aft as well. Additionally, when the movable forward wall 1032 is in the forward position, the main combustion zone 1002 is relatively larger than when the movable forward wall 1032 is in the aft position.

The reconfigurable multifuel combustor 1000 is reconfigurable to operate in the configuration shown in FIG. 10B, also referred to as the hydrogen configuration, wherein the secondary TV combustion zone is a smaller, hydrogen TV combustion zone 1006'. In the hydrogen configuration, the flow of Jet-A 1020 (FIG. 10A) is not operational, and, instead, one or more flows of hydrogen 1026 enter the hydrogen TV combustion zone 1006' through one or more hydrogen inlets 1027 along with the one or more flows of air 1022 through the one or more air inlets 1023 in an asymmetric pattern to form a hydrogen and air mixture 1012 flowing in a circular or vortex shaped flow, similar to the of the Jet-A and air mixture 1008, albeit a smaller circular flow or a smaller vortex shaped flow. The air flow rates of the one or more flows of air 1022 are controlled by one or more flow control valves 1024, each corresponding to one of the one or more flows of air 1022. As the flow of Jet-A 1020, and the one or more flows of hydrogen 1026, when operational, have different requirements for the air flow rate of the flows of air 1022, the flow control valves 1024 allow the flows of air 1022 to be adjusted to optimize the fuel to air ratio for either the Jet-A and air mixture 1008 (FIG. 10A) or the hydrogen and air mixture 1012 (FIG. 10B).

The reconfigurable multifuel combustor 1000, in the Jet-A configuration (FIG. 10A), has a larger secondary, TV combustion zone, the Jet-A TV combustion zone 1006 with an axial length of x, than in the hydrogen configuration, having the hydrogen TV combustion zone 1006', with an axial length of x', less than the axial length of x, of the Jet-A configuration. The larger, Jet-A TV combustion zone 1006 accommodates the longer residence time required for combusting the flow of Jet-A 1020, as compared to the relatively smaller hydrogen TV combustion zone 1006' for accommodating the relatively shorter residence time of the one or more flows of hydrogen 1026. In order to reconfigure from the Jet-A TV combustion zone 1006 to the hydrogen TV combustion zone 1006', and back, the movable forward wall 1032 moves along the axial direction with respect to the longitudinal centerline axis 12. In the Jet-A configuration, the movable forward wall 1032 is in a relatively forward position and, when in the hydrogen configuration, the movable forward wall 1032 is in a relatively aft position. The movable forward wall 1032 is connected to a linear shaft 1036. The linear shaft 1036 is driven axially forward and aft, relative to the longitudinal centerline axis 12 by an axially operating actuator 1034. The actuator 1034 is positioned axially aft of the movable forward wall 1032 such that, when in extended position, the reconfigurable multifuel combustor 1000 is in the Jet-A configuration (FIG. 10A) and when in a retracted position, the reconfigurable multifuel combustor 1000 is in the hydrogen configuration (FIG. 10B).

Several features of FIGS. 10A and 10B are shown and labeled with reference numerals, but not explicitly described herein. Elements of FIGS. 10A and 10B with reference numerals in the 1000-series, but not described above, are identical to those corresponding elements in FIG. 9, with otherwise identical reference numerals in the 900-series.

Figure 11A:
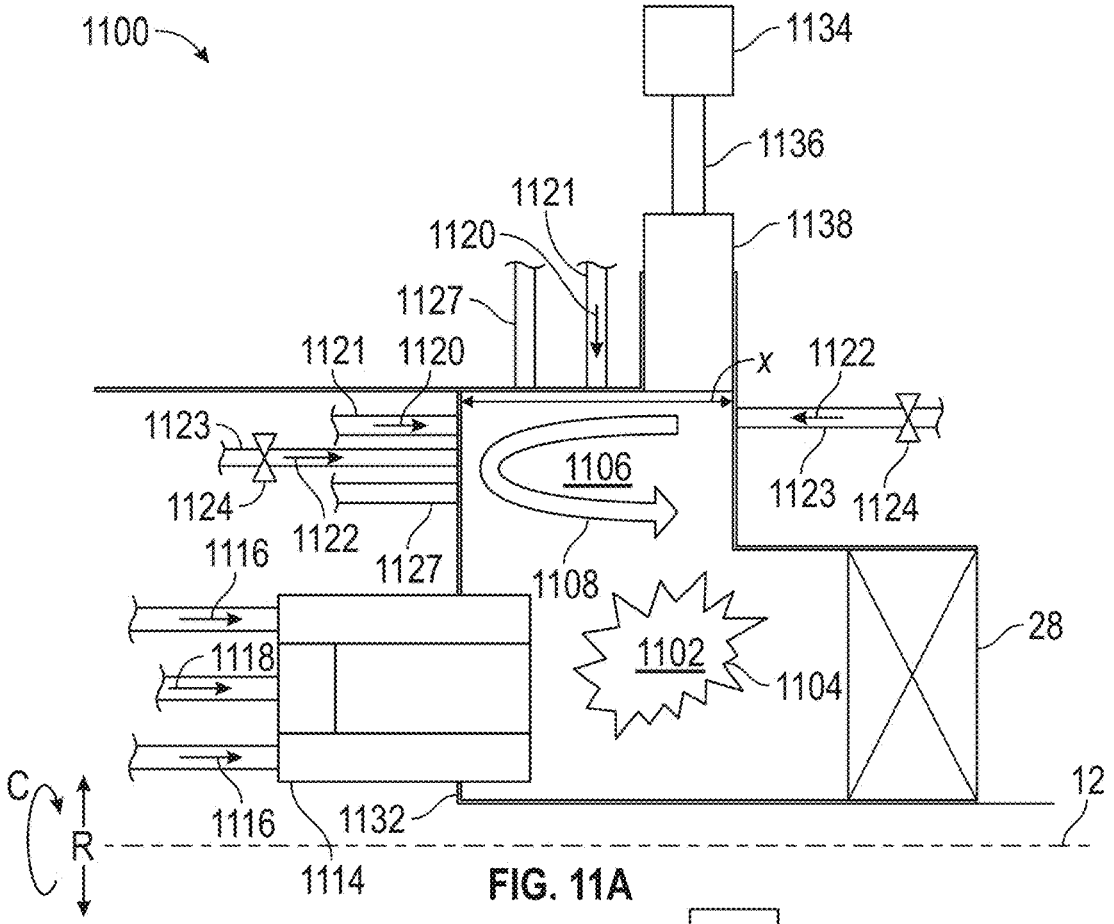
FIG. 11A is a schematic view of an embodiment of a reconfigurable multifuel combustor in a first configuration, according to the present disclosure.
Figure 11B:
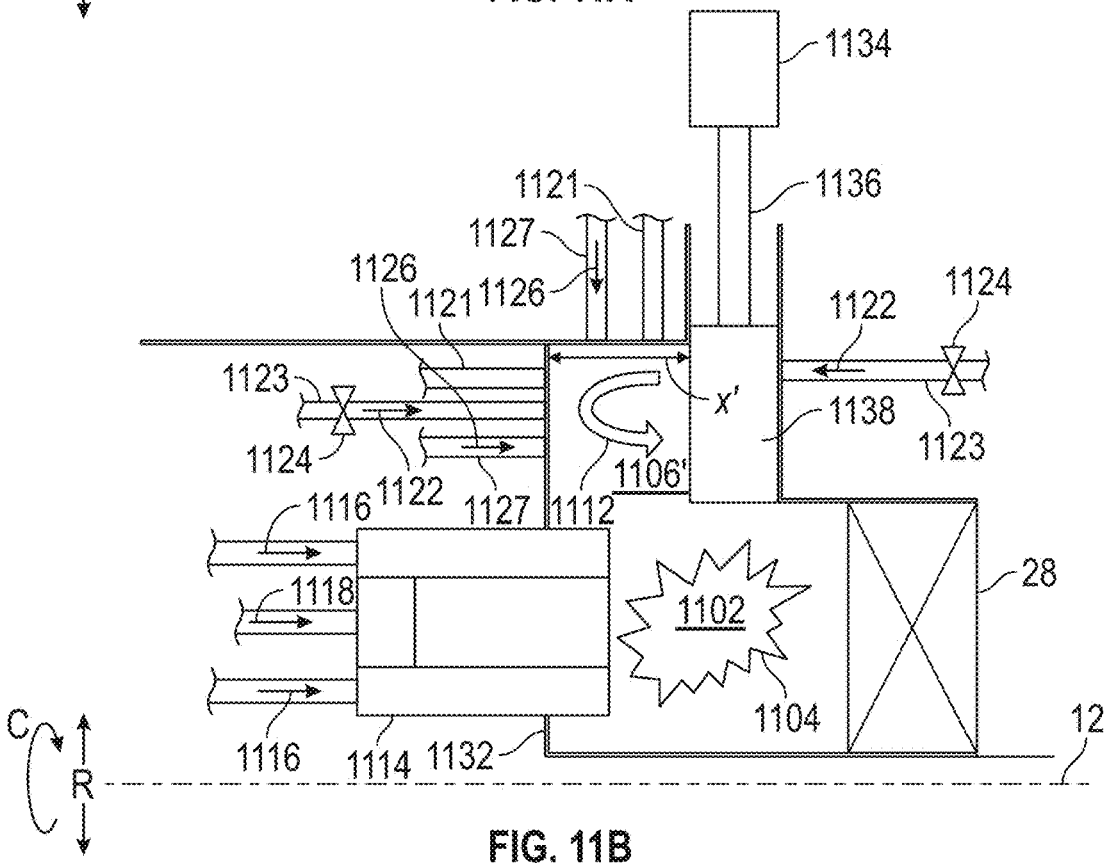
FIG. 11B is a schematic view of an embodiment of a reconfigurable multifuel combustor in a second configuration, according to the present disclosure.

FIGS. 11A and 11B illustrate another embodiment of a reconfigurable multifuel combustor 1100. Like the reconfigurable multifuel combustor 1000 of FIGS. 10A and 10B, the reconfigurable multifuel combustor 1100 has a secondary combustion zone that, when in a Jet-A configuration, is a relatively larger, Jet-A TV combustion zone 1106, and, when in a hydrogen configuration, is a relatively smaller hydrogen TV combustion zone 1106'.

As in the reconfigurable multifuel combustor 1000, when in the Jet-A configuration, as shown in FIG. 11A, one or more operating flows of Jet-A 1120 are introduced to the relatively larger Jet-A TV combustion zone 1106 with the axial length x via one or more Jet-A inlets 1121, to mix with one or more flows of air 1122 received via one or more air inlets 1123 and controlled by flow control valves 1124, in an asymmetric pattern, to form a Jet-A and air mixture 1108 with a circular or a vortex flow shape in the Jet-A TV combustion zone 1106, such that the Jet-A and air mixture 1108 flows radially toward a main combustion zone 1102 along a forward wall 1132. In the Jet-A configuration, one or more flows of hydrogen 1126 do not operate.

In the Jet-A configuration, the flow control valves 1124 operate to allow the flow of air 1122 into the Jet-A TV combustion zone 1106, to form an appropriate Jet-A and air mixture 1108 for combustion.

In the hydrogen configuration, as shown in FIG. 11B, the secondary combustion zone of the reconfigurable multifuel combustor 1100 is a relatively smaller, hydrogen TV combustion zone 1006', having the axial length x'. The hydrogen TV combustion zone 1106' receives the one or more operating flows of hydrogen 1126 through one or more hydrogen inlets 1127 and one or more flows of air 1122 through the one or more air inlets 1123 in a similarly asymmetric pattern, to form a hydrogen and air mixture 1112 flowing in a similar, albeit smaller, or vortex shape. In the hydrogen configuration, the one or more flows of Jet-A 1120 do not operate.

In the hydrogen configuration, the flow control valves 1124 operate to allow a volume flow of air 1122 into the hydrogen TV combustion zone 1106', to form the appropriate hydrogen and air mixture 1112 for combustion.

The reconfigurable multifuel combustor 1100, as shown in FIGS. 11A and 11B, has the main combustion zone 1102 for combusting a main fuel and air mixture 1104 as received from an injector-mixer assembly 1114. The injector-mixer assembly 1114, disposed in the forward wall 1132, receives and mixes one or more flows of main fuel 1116 and one or more flows of main air 1118, to form the main fuel and air mixture 1104.

In the reconfigurable multifuel combustor 1100 of FIGS. 11A and 11B, the secondary combustion zone is reconfigurable between the Jet-A TV combustion zone 1106 and the hydrogen TV combustion zone 1106' by the use of a plurality radial plugs 1138 (one shown), circularly arrayed about the reconfigurable multifuel combustor 1100 and inserted into the Jet-A TV combustion zone 1106, in order to configure the smaller, hydrogen TV combustion zone 1106'. In the Jet-A configuration of FIG. 11A, with the relatively larger Jet-A TV combustion zone 1106, the plurality of radial plugs 1138 is withdrawn, as shown. In the hydrogen configuration of FIG. 11B, with the relatively smaller hydrogen TV combustion zone 1106', the plurality of radial plugs 1138 is inserted. Each of the plurality of radial plugs 1138 is connected to one of a corresponding plurality of actuators 1134 via a corresponding plurality of shafts 1136. In the Jet-A configuration of FIG. 11A, the plurality of actuators 1134 is retracted, withdrawing the plurality of radial plugs 1138. In the hydrogen configuration of FIG. 11B, the plurality of actuators is extended, inserting the plurality of radial plugs 1138.

The secondary combustion zone (e.g. the Jet-A TV combustion zone 1106 or the hydrogen TV combustion zone 1106') of the reconfigurable multifuel combustor 1100 is shown radially outside of the main combustion zone 1102. Other configurations are contemplated, wherein the secondary combustion zone is arranged radially inside the main combustion zone 1102.

A clear advantage of the reconfigurable multifuel combustor 1000 or the reconfigurable multifuel combustor 1100, over otherwise equivalent, non-reconfigurable multifuel combustors, is that the reconfigurable multifuel combustor 1000 and the reconfigurable multifuel combustor 1100 each has only one secondary combustion zone that is reconfigurable to accommodate the optimized mixture of disparate fuels and air, within a single, albeit reconfigurable secondary combustion zone. The reconfigurable multifuel combustor, therefore, is also smaller overall, requiring less total space than the otherwise equivalent multifuel combustors requiring separate zones for each of the disparate fuels to be combusted in secondary zones, such as the multifuel combustor 600 or the multifuel combustor 700.

Several features of FIGS. 11A and 11B are shown and labeled with reference numerals, but not explicitly described herein. Elements of FIGS. 11A and 11B with reference numerals in the 1100-series, but not described above, are identical to those corresponding elements in FIG. 10, with otherwise identical reference numerals in the 1000-series.

Figure 12:
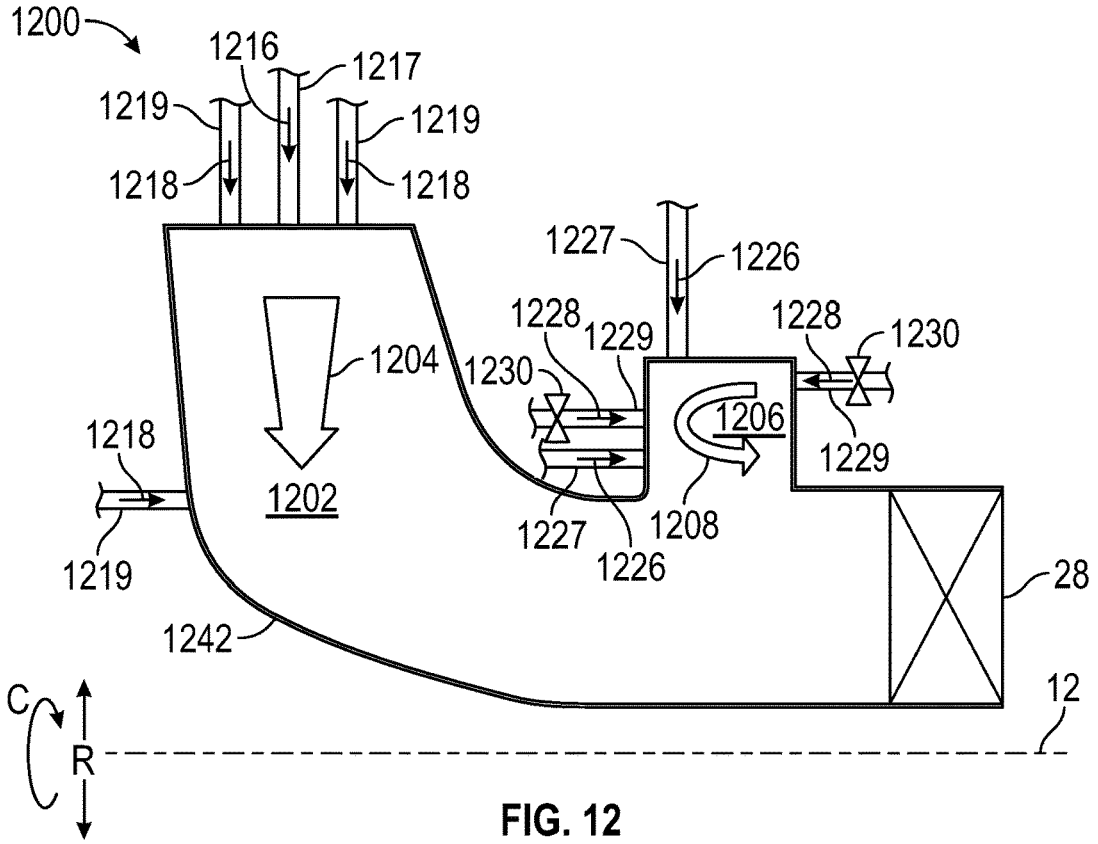
FIG. 12 is a schematic view of an embodiment of a multifuel combustor, according to the present disclosure.

FIG. 12 illustrates a multifuel combustor 1200 with a Jet-A TRI combustion zone 1202 for combusting a Jet-A and air mixture 1204 and a hydrogen TV combustion zone 1206 for combusting a hydrogen and air mixture 1208 arranged downstream of the Jet-A TRI combustion zone 1202. The Jet-A TRI combustion zone 1202 is of a relatively larger size and positioned upstream to accommodate the relatively long residence time of Jet-A fuel. The hydrogen TV combustion zone 1206 is of a relatively smaller size and positioned downstream to accommodate the relatively shorter residence time of hydrogen fuel.

The Jet-A TRI combustion zone 1202 receives one or more flows of Jet-A 1216 through one or more Jet-A inlets 1217 and one or more flows of air 1218 through one or more air inlets 1219 to form the Jet-A fuel and air mixture 1204 flowing in a radially inward direction with respect to the longitudinal centerline axis 12. The Jet-A TRI combustion zone 1202 is defined in part by a curved forward wall 1242 that redirects the flow of the Jet-A and air mixture 1204 in the axially aft direction, with respect to the longitudinal centerline axis 12.

The hydrogen TV combustion zone 1206 receives one or more flows of hydrogen 1226 through one or more hydrogen inlets 1227 and one or more flows of air 1228 through one or more air inlets 1229 to mix and form the hydrogen and air mixture 1208. The one or more flows of hydrogen 1226 and the one or more flows of air 1228 enter the hydrogen TV combustion zone 1206 in an asymmetric pattern to form a circular or a vortex shaped flow. The direction of the hydrogen and air mixture 1208 is primarily axially aft upon intersecting with the flowing, combusting Jet-A and air mixture 1204. The multifuel combustor 1200 operates with or without the hydrogen TV combustion zone 1206 in operation, as dictated by the operating condition requirements of the turbine engine 10 (FIG. 1). When not in operation, the air flow rate of the one or more flows of air 1228 is adjusted through corresponding control valves 1230, to reduce the air flow rate of the one or more flows of air 1228 to prevent a blowout condition while still maintaining adequate cooling of the hydrogen TV combustion zone 1206.

Although not shown, either the hydrogen TV combustion zone 1206 or both the Jet-A TRI combustion zone 1202 and the hydrogen TV combustion zone 1206 may be axially aligned with and radially outside of the HP turbine 28. In such a radial arrangement, respective fuel and air mixtures (e.g., Jet-A and air mixture 1204 and hydrogen and air mixture 1208) undergoing combustion or the resultant combustion gases pass into cavities in the HP turbine 28 via turbine vanes, rather than being oriented entirely sequentially with the HP turbine 28. Such a radial arrangement allows for a shorter overall length of the turbine engine, rather than an otherwise similar turbine engine with sequential configuration.

Figure 13:
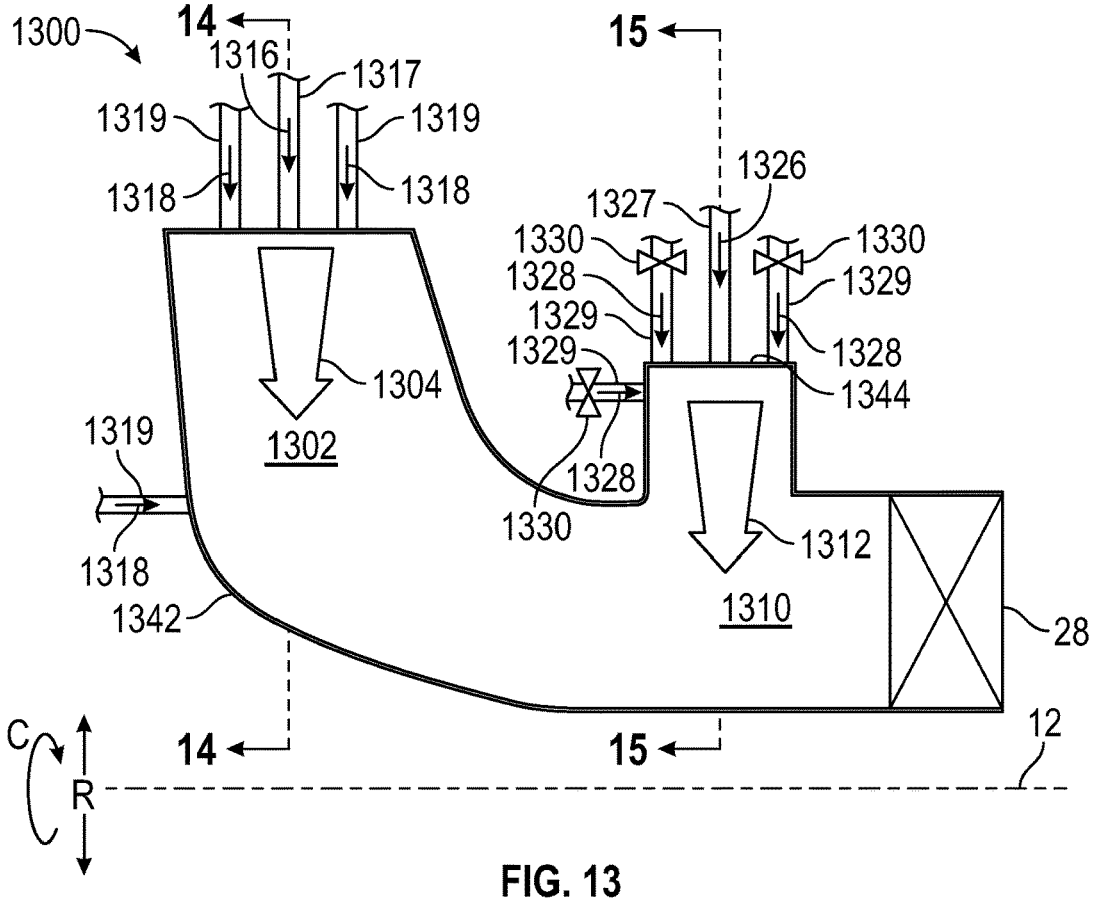
FIG. 13 is a schematic view of an embodiment of a multifuel combustor, according to the present disclosure.

FIG. 13 illustrates a multifuel combustor 1300, similar to the multifuel combustor 1200, but with a hydrogen TRI combustion zone 1310 downstream of a Jet-A TRI combustion zone 1302. The Jet-A TRI combustion zone 1302 is of a relatively larger size and is positioned upstream to accommodate the relatively longer resident time requirements of Jet-A fuel, whereas the hydrogen TRI combustion zone 1310 is of relatively smaller size and is located downstream to accommodate the relatively shorter resident time requirement of hydrogen fuel.

In the hydrogen TRI combustion zone 1310, one or more flows of hydrogen 1326 are received through one or more hydrogen inlets 1327 and one or more flows of air 1328 are received through one or more air inlets 1329, through a circularly shaped outer wall 1344 in the hydrogen TRI combustion zone 1310. The one or more flows of hydrogen 1326 and the one or more flows of air 1328 enter the hydrogen TRI combustion zone 1310 at a fuel injection angle and an air injection angle, as will be described later, to form a hydrogen and air mixture 1312 flowing in at least a partially circular pattern for combustion.

The hydrogen TRI combustion zone 1310 is not in operation, when operational conditions or other considerations dictate hydrogen not be used, as described. In such circumstances, when hydrogen is not to be combusted in the hydrogen TRI combustion zone 1310, the one or more flows of hydrogen 1326 are not operational, but the one or more flows of air 1328 are still operational. When the hydrogen TRI combustion zone 1310 is not operating, the one or more flows of air 1328 operate at a lower volume air flow rate, controlled by flow control valves 1330, as the one or more flows of air 1328 are not required for combustion in the hydrogen TRI combustion zone 1310, but provide cooling to the hydrogen TRI combustion zone 1310.

Several features of FIG. 13 are shown and labeled with reference numerals, but not explicitly described herein. Elements of FIG. 13 with reference numerals in the 1300-series, but not described above, are identical to those corresponding elements in FIG. 12, with otherwise identical reference numerals in the 1200-series. For example, Jet-A inlets 1217 of FIG. 12 are depicted as Jet-A inlets 1317 in FIG. 13, and one or more air inlets 1219 of FIG. 12 are depicted as one or more air inlets 1319 in FIG. 13.

Figure 14:
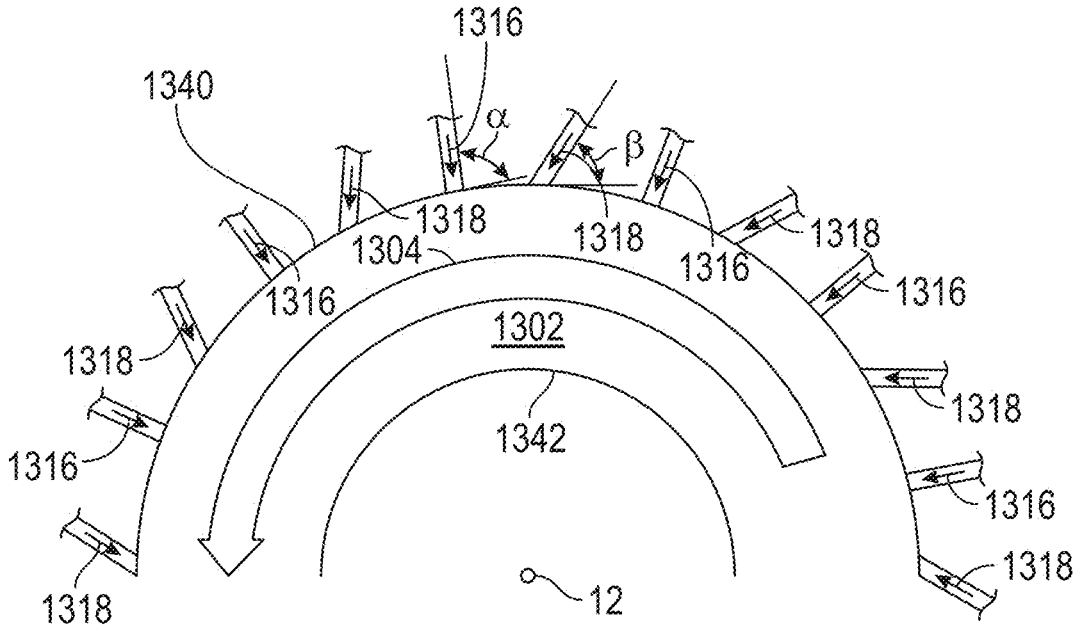
FIG. 14 is another schematic view of the multifuel combustor of FIG. 14, showing a tangential radial inflow combustion zone, according to the present disclosure.

FIG. 14 illustrates a schematic view of the Jet-A TRI combustion zone 1302, taken at line 14-14 of FIG. 13 and defined between a circularly shaped outer wall 1340 and an inner wall 1342 of the Jet-A TRI combustion zone 1302. Multiple flows of Jet-A 1316 enter the Jet-A TRI combustion zone 1302 at a Jet-A injection angle α with respect to the tangent of the circularly shaped outer wall 1340 of the Jet-A TRI combustion zone 1302. Similarly, multiple flows of air 1318 enter the Jet-A TRI combustion zone 1302 at an air injection angle β with respect to the tangent of the circularly shaped outer wall 1340 of the Jet-A TRI combustion zone 1302. The multiple flows of Jet-A 1316 and the multiple flows of air 1318 combine to form a Jet-A and air mixture 1304, flowing at least partially in a circular direction about the longitudinal centerline axis 12 for combustion in the Jet-A TRI combustion zone 1302.

Figure 15:
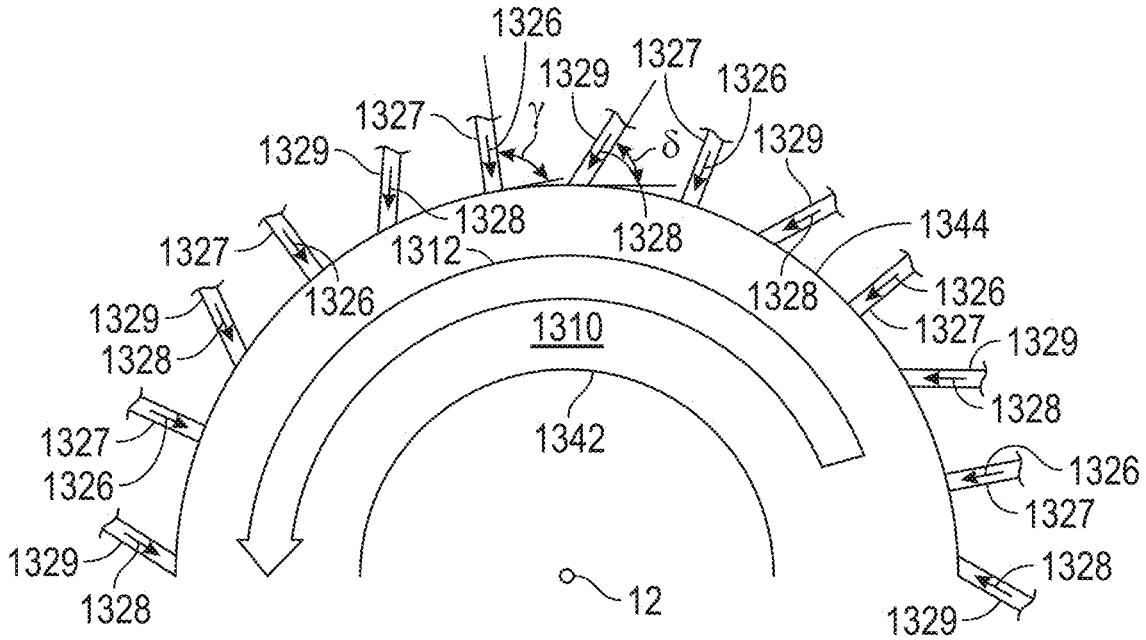
FIG. 15 is another schematic view of the multifuel combustor of FIG. 14, showing a tangential radial inflow combustion zone, according to the present disclosure.

FIG. 15 illustrates a schematic view of the hydrogen TRI combustion zone 1310, taken at line 15-15 of FIG. 13 and defined between the circularly shaped outer wall 1344 and an inner wall 1342 of the hydrogen TRI combustion zone 1310. Multiple flows of hydrogen 1326 enter the hydrogen TRI combustion zone 1310 at a hydrogen injection angle γ with respect to the tangent of the circularly shaped outboard wall 1344 of the hydrogen TRI combustion zone 1310. Similarly, multiple flows of air 1328 enter the hydrogen TRI combustion zone 1310 at an air injection angle δ with respect to the tangent of the circularly shaped outer wall 1344 of the hydrogen TRI combustion zone 1310. The multiple flows of hydrogen 1326 and the multiple flows of air 1328 combine to form the hydrogen and air mixture 1312, flowing at least partially in a circular direction about the longitudinal centerline axis 12 for combustion in the hydrogen TRI combustion zone 1310.

The Jet-A injection angle α and the air injection angle β are relatively lesser (closer to being tangent to the outboard wall) angles than hydrogen injection angle γ and air injection angle δ. As such, Jet-A injection angle α and air injection angle β will result in the flows of Jet-A 1316, the flows of air 1318, and the resultant Jet-A and air mixture 1304 remaining in the Jet-A TRI combustion zone 1302 for a longer period of time than relatively greater angles of injection, to accommodate the relatively longer residence time of Jet-A fuel. Conversely, the relative greater hydrogen injection angle γ and air injection angle δ will result in the one or more flows of hydrogen 1326, the flows of air 1328, and the resultant hydrogen and air mixture 1312 remaining in the hydrogen TRI combustion zone 1310 for a shorter period of time than relatively lesser angles, to accommodate the relatively shorter residence time of hydrogen fuel.

The arrangement of FIGS. 14 and 15, specifically, the angled orientation of the fuel and air flows, with respect to the tangent of the combustion zones, is similar for all tangential radial inflow (TRI) combustion zones described herein. That is, all TRI combustion zones discussed in the aforementioned embodiments described with respect to FIGS. 9, 12, and 13 have various fuel flows and air flows, which enter through an outboard wall, at angles with respect to the tangent of the outboard wall, to generate an at least partially circularly flowing fuel and air mixture within the respective TRI combustion zone for combustion.

A combustor in a turbine engine may be configured to combust multiple disparate fuels. Each of the disparate fuels has advantages over the other. Combusting the disparate fuels in alternatives or in combination, as dictated by operation conditions or other considerations, increases the flexibility of the turbine engine and the ability of the turbine engine to function within changing requirements of safety, emissions, or the like. A reconfigurable multifuel combustor allows for similarly improved flexibility of the turbine engine to function in variable conditions, with a smaller overall space requirement.

Further aspects are provided by the subject matter of the following clauses.

A combustor of a turbine engine, the combustor comprising a first combustion zone operable to combust a first fuel and air mixture, at least one first fuel inlet connected to the first combustion zone, providing a first fuel to the first combustion zone, at least one first air inlet connected to the first combustion zone, providing first zone air to the first combustion zone, the first fuel and the first zone air combining to form the first fuel and air mixture in the first combustion zone, a second combustion zone operable depending on turbine engine operating parameters, for combusting a second fuel and air mixture, at least one second fuel inlet connected to the second combustion zone, providing a second fuel to the second combustion zone, that operates when the second combustion zone is operating and does not operate when the second combustion zone is not operating, and at least one second air inlet connected to the second combustion zone, providing second zone air to the second combustion zone, the second fuel and the second zone air combining to form the second fuel and air mixture in the second combustion zone, wherein the first fuel and the second fuel are disparate fuels.

The combustor of the preceding clause, wherein the second combustion zone is disposed downstream of the first combustion zone.

The combustor of any preceding clause, wherein the first fuel is a relatively longer residence time fuel and the second fuel is a relatively shorter residence time fuel.

The combustor of any preceding clause, wherein the first fuel is Jet-A.

The combustor of any preceding clause, wherein the first fuel is sustainable aviation fuel.

The combustor of any preceding clause, wherein the second fuel is hydrogen.

The combustor of any preceding clause, wherein the second combustion zone is a trapped vortex combustion zone, disposed downstream of the first combustion zone.

The combustor of any preceding clause, wherein the second combustion zone is a tangential radial inflow combustion zone, disposed downstream of the first combustion zone.

The combustor of any preceding clause, further comprising a third combustion zone disposed upstream of the second combustion zone, operable depending on one or more turbine engine operating parameters, for combusting a third fuel and air mixture, at least one third fuel inlet, connected to the third combustion zone, providing a third fuel to the third combustion zone, that operates when the third combustion zone is operating and does not operate when the third combustion zone is not operating, and at least one third air inlet, providing third zone air to the third combustion zone, the third fuel and the third zone air combining to form the third fuel and air mixture in the third combustion zone, wherein third fuel is of a similarly longer residence time as the first fuel.

The combustor of the preceding clause, wherein the second combustion zone is smaller than the third combustion zone.

The combustor of any preceding clause, further comprising a curved forward wall, arranged such that the third fuel and air mixture flowing along the curved forward wall, flows into the second combustion zone.

The combustor of any preceding clause, wherein the first combustion zone is a tangential radial inflow combustion zone.

The combustor of the preceding clause, wherein the second combustion zone is a tangential radial inflow combustion zone, the at least one first fuel inlet is arranged at a first fuel injection angle, the at least one first air inlet is arranged at a first air injection angle, the at least one second fuel inlet is arranged at a second fuel injection angle, different than the first fuel injection angle, and the at least one second air inlet is arranged a second air injection angle, different than the first air injection angle.

A combustor of a turbine engine, the combustor comprising a first combustion zone operable to combust a first fuel and air mixture, at least one first zone fuel inlet, providing a first zone fuel to the first combustion zone, at least one first zone air inlet, providing first zone air to the first combustion zone, the first zone fuel and the first zone air combining to form the first fuel and air mixture in the first combustion zone, and a second combustion zone with at least one second zone first fuel inlet for providing a second zone first fuel, at least one second zone second fuel inlet for providing a second zone second fuel, and at least one second zone air inlet for providing second zone air, the second combustion zone being reconfigurable depending on turbine engine operating parameters, for operating to combust a second zone first fuel and air mixture, for operating to combust a second zone second fuel and air mixture, or for not operating, wherein the at least one second zone air inlet to the second combustion zone is operable at a second zone first air flow rate when the second combustion zone operates to combust the second zone first fuel and air mixture and is operable at a second air flow rate when the second combustion zone operates to combust the second zone second fuel and air mixture, the at least one second zone first fuel inlet operates only when the second combustion zone operates to combust the second zone first fuel and air mixture, the second zone first fuel and the second zone air combining to form the second zone first fuel and air mixture, the at least one second zone second fuel inlet operates only when the second combustion zone operates to combust the second zone second fuel and air mixture, the second zone air and the second zone second fuel combining to form the second zone second fuel and air mixture, and the second combustion zone is reconfigurable between a second zone first size for combusting the second zone first fuel and air mixture and a second size for combusting the second zone second fuel and air mixture, the second zone first size being larger in volume than the second zone second size.

The combustor of the preceding clause, wherein the second zone second fuel is hydrogen.

The combustor of any preceding clause, wherein the second zone first fuel has a longer residence time than the second zone second fuel.

The combustor of any preceding clause, further comprising a movable forward wall, movable between a forward position to define a larger volume second combustion zone and an aft position to define a smaller second combustion zone.

The combustor of any preceding clause, further comprising a plurality of radial plugs, radially insertable into the second combustion zone, which, when withdrawn, define a larger volume second combustion zone and, when inserted, define a smaller volume second combustion zone.

The combustor of any preceding clause, wherein the first zone fuel is of a same fuel as the second zone first fuel.

The combustor of the preceding clause, wherein both the first zone fuel and the second zone first fuel are Jet-A fuel or sustainable aviation fuel.

The combustor of any preceding clause, wherein the at least one second air inlet provides air at an increased air flow rate when the second combustion zone is operating and provides air at a reduced non-zero air flow rate when the second combustion zone is not operating.

The combustor of any preceding clause, wherein the first combustion zone and the third combustion zone are axially aligned upstream of the second combustion zone.

The combustor of any preceding clause, wherein the third combustion zone is a trapped vortex third combustion zone.

The combustor of any preceding clause, wherein one of the second combustion zone and the third combustion zone is disposed radially inside of the first combustion zone with respect to a longitudinal centerline axis and the other of the second combustion zone and the third combustion zone is disposed radially outside of the first combustion zone with respect to the longitudinal centerline axis.

The combustor of any preceding clause, wherein the at least one third air inlet provides air at an increased flow rate when the third combustion zone is operating and provides air at a reduced non-zero flow rate when the third combustion zone is not operating.

The combustor of any preceding clause, wherein the at least one first fuel inlet and the at least one first air inlet provide fuel and air to a TAPS injector-mixer assembly for mixing and injecting the first fuel and air mixture into the first combustion zone.

The combustor of any preceding clause, wherein the at least one first fuel inlet and the at least one first air inlet provide fuel and air to a swirl cup mixer for mixing and injecting the first fuel and air mixture into the first combustion zone.

The combustor of any preceding clause, wherein combustion gases flowing from the second combustion zone are transported to a turbine via second zone turbine vane transport cavities.

The combustor of the preceding clause, wherein combustion gases flowing from the first combustion zone are transported to the turbine via first zone turbine vane transport cavities.

The combustor of any preceding clause, wherein the first zone fuel is Jet-A.

The combustor of any preceding clause, wherein the first zone fuel is sustainable aviation fuel.

The combustor of any preceding clause, wherein the second zone first fuel is Jet-A.

The combustor of any preceding clause, wherein the second zone first fuel is sustainable aviation fuel.

The combustor of any preceding clause, wherein the at least one second zone air inlet operates at a second zone first air flow rate when the second combustion zone operates to combust the second zone first fuel and air mixture, the at least one second zone air inlet operates at a second zone second air flow rate when the second combustion zone operates to combust the second zone second fuel and air mixture, and the at least one second zone air inlet operates at a reduced non-zero second zone air flow rate when the second combustion zone is not operating, and the reduced non-zero second zone air flow rate is less than both the second zone first air flow rate and the second zone second air flow rate.

The combustor of any preceding clause, wherein the movable forward wall is connected to a shaft, the shaft is connected to an axially operating actuator, and the axially operating actuator is operable to move the movable forward wall between the forward position and the aft position.

The combustor of the preceding clause, wherein an inboard wall or an outboard wall is connected to the movable forward wall and is axially movable with the movable forward wall.

A turbine engine comprising a compressor section that provides a compressed air flow, a fuel system that provides fuel, a combustor located downstream of the compressor section, the combustor receiving the compressed air flow and the fuel to form a fuel and air mixture, and combusting the fuel and air mixture to generate combustion gases, the combustor comprising a first combustion zone operable to combust a first fuel and air mixture, at least one first fuel inlet connected to the first combustion zone, providing a first fuel to the first combustion zone, at least one first air inlet connected to the first combustion zone, providing first zone air to the first combustion zone, the first fuel and the first zone air combining to form the first fuel and air mixture in the first combustion zone, a second combustion zone operable depending on turbine engine operating parameters, for combusting a second fuel and air mixture, at least one second fuel inlet connected to the second combustion zone, providing a second fuel to the second combustion zone, that operates when the second combustion zone is operating and does not operate when the second combustion zone is not operating, and at least one second air inlet connected to the second combustion zone, providing second zone air to the second combustion zone, the second fuel and the second zone air combining to form the second fuel and air mixture in the second combustion zone, and a turbine section that is caused to rotate by the combustion gases, wherein the first fuel and the second fuel are disparate fuels The turbine engine of the preceding clause, wherein the second combustion zone is disposed downstream of the first combustion zone.

The turbine engine of any preceding clause, wherein the first fuel is a relatively longer residence time fuel, and the second fuel is a relatively shorter residence time fuel.

The turbine engine of any preceding clause, wherein the first fuel is Jet-A.

The turbine engine of any preceding clause, wherein the first fuel is sustainable aviation fuel.

The turbine engine of any preceding clause, wherein the second fuel is hydrogen.

The turbine engine of any preceding clause, wherein the second combustion zone is a trapped vortex combustion zone, disposed downstream of the first combustion zone.

The turbine engine of any preceding clause, wherein the second combustion zone is a tangential radial inflow combustion zone, disposed downstream of the first combustion zone.

The turbine engine of any preceding clause, the combustor further comprising a third combustion zone disposed upstream of the second combustion zone, operable depending on one or more turbine engine operating parameters, for combusting a third fuel and air mixture, at least one third fuel inlet, connected to the third combustion zone, providing a third fuel to the third combustion zone, that operates when the third combustion zone is operating and does not operate when the third combustion zone is not operating, and at least one third air inlet, providing third zone air to the third combustion zone, the third fuel and the third zone air combining to form the third fuel and air mixture in the third combustion zone, wherein third fuel is of a similarly longer residence time as the first fuel.

The turbine engine of the preceding clause, wherein the second combustion zone is smaller than the third combustion zone.

The turbine engine of any preceding clause, the combustor further comprising a curved forward wall, arranged such that the third fuel and air mixture flowing along the curved forward wall, flows into the second combustion zone.

The turbine engine of any preceding clause, wherein the first combustion zone is a tangential radial inflow combustion zone.

The turbine engine of any preceding clause, wherein the second combustion zone is a tangential radial inflow combustion zone, the at least one first fuel inlet is arranged at a first fuel injection angle, the at least one first air inlet is arranged at a first air injection angle, the at least one second fuel inlet is arranged at a second fuel injection angle, different than the first fuel injection angle, and the at least one second air inlet is arranged a second air injection angle, different than the first air injection angle.

A turbine engine comprising a compressor section that provides a compressed air flow, a fuel system that provides fuel, a combustor located downstream of the compressor section, the combustor receiving the compressed air flow and the fuel to form a fuel and air mixture, and combusting the fuel and air mixture to generate combustion gases, the combustor comprising a first combustion zone operable to combust a first fuel and air mixture, at least one first zone fuel inlet, providing a first zone fuel to the first combustion zone, at least one first zone air inlet, providing first zone air to the first combustion zone, the first zone fuel and the first zone air combining to form the first fuel and air mixture in the first combustion zone, and a second combustion zone with at least one second zone first fuel inlet for providing a second zone first fuel, at least one second zone second fuel inlet for providing a second zone second fuel, and at least one second zone air inlet for providing second zone air, the second combustion zone being reconfigurable depending on turbine engine operating parameters, for operating to combust a second zone first fuel and air mixture, for operating to combust a second zone second fuel and air mixture, or for not operating, and a turbine section that is caused to rotate by the combustion gases, wherein the at least one second zone air inlet to the second combustion zone is operable at a second zone first air flow rate when the second combustion zone operates to combust the second zone first fuel and air mixture and is operable at a second air flow rate when the second combustion zone operates to combust the second zone second fuel and air mixture, the at least one second zone first fuel inlet operates only when the second combustion zone operates to combust the second zone first fuel and air mixture, the second zone first fuel and the second zone air combining to form the second zone first fuel and air mixture, the at least one second zone second fuel inlet operates only when the second combustion zone operates to combust the second zone second fuel and air mixture, the second zone air and the second zone second fuel combining to form the second zone second fuel and air mixture, and the second combustion zone is reconfigurable between a second zone first size for combusting the second zone first fuel and air mixture and a second size for combusting the second zone second fuel and air mixture, the second zone first size being larger in volume than the second zone second size.

The turbine engine of the preceding clause, wherein the second zone second fuel is hydrogen.

The turbine engine of any preceding clause, wherein the second zone first fuel has a longer residence time than the second zone second fuel.

The turbine engine of any preceding clause, the combustor further comprising a movable forward wall, movable between a forward position to define a larger volume second combustion zone and an aft position to define a smaller second combustion zone.

The turbine engine of any preceding clause, the combustor further comprising a plurality of radial plugs, radially insertable into the second combustion zone, which, when withdrawn, define a larger volume second combustion zone and, when inserted, define a smaller volume second combustion zone.

The turbine engine of any preceding clause, wherein the first zone fuel is of a same fuel as the second zone first fuel.

The turbine engine of the preceding clause, wherein both the first zone fuel and the second zone first fuel are Jet-A fuel or sustainable aviation fuel.

The turbine engine of any preceding clause, wherein the at least one second air inlet provides air at an increased air flow rate when the second combustion zone is operating and provides air at a reduced non-zero air flow rate when the second combustion zone is not operating.

The turbine engine of any preceding clause, wherein the first combustion zone and the third combustion zone are axially aligned upstream of the second combustion zone.

The turbine engine of any preceding clause, wherein the third combustion zone is a trapped vortex third combustion zone.

The turbine engine of any preceding clause, wherein one of the second combustion zone and the third combustion zone is disposed radially inside of the first combustion zone with respect to a longitudinal centerline axis and the other of the second combustion zone and the third combustion zone is disposed radially outside of the first combustion zone with respect to the longitudinal centerline axis.

The turbine engine of any preceding clause, wherein the at least one third air inlet provides air at an increased flow rate when the third combustion zone is operating and provides air at a reduced non-zero flow rate when the third combustion zone is not operating.

The turbine engine of any preceding clause, wherein the at least one first fuel inlet and the at least one first air inlet provide fuel and air to a TAPS injector-mixer assembly for mixing and injecting the first fuel and air mixture into the first combustion zone.

The turbine engine of any preceding clause, wherein the at least one first fuel inlet and the at least one first air inlet provide fuel and air to a swirl cup mixer for mixing and injecting the first fuel and air mixture into the first combustion zone.

The turbine engine of any preceding clause, wherein combustion gases flowing from the second combustion zone are transported to a turbine via second zone turbine vane transport cavities.

The combustor of the preceding clause, wherein combustion gases flowing from the first combustion zone are transported to the turbine via first zone turbine vane transport cavities.

The turbine engine of any preceding clause, wherein the first zone fuel is Jet-A.

The turbine engine of any preceding clause, wherein the first zone fuel is sustainable aviation fuel.

The turbine engine of any preceding clause, wherein the second zone first fuel is Jet-A.

The turbine engine of any preceding clause, wherein the second zone first fuel is sustainable aviation fuel.

The turbine engine of any preceding clause, wherein the at least one second zone air inlet operates at a second zone first air flow rate when the second combustion zone operates to combust the second zone first fuel and air mixture, the at least one second zone air inlet operates at a second zone second air flow rate when the second combustion zone operates to combust the second zone second fuel and air mixture, and the at least one second zone air inlet operates at a reduced non-zero second zone air flow rate when the second combustion zone is not operating, and the reduced non-zero second zone air flow rate is less than both the second zone first air flow rate and the second zone second air flow rate.

The turbine engine of any preceding clause, wherein the movable forward wall is connected to a shaft, the shaft is connected to an axially operating actuator, and the axially operating actuator is operable to move the movable forward wall between the forward position and the aft position.

The turbine engine of the preceding clause, wherein an inboard wall or an outboard wall is connected to the movable forward wall and is axially movable with the movable forward wall.

A method of operating a multifuel combustor, the method comprising injecting a first fuel through at least one first fuel inlet into a first combustion zone, injecting first zone air through at least one first air inlet into the first combustion zone, mixing the first zone air and the first fuel to form a first fuel and air mixture, and combusting the first fuel and air mixture to generate first combustion gases, when operating a second combustion zone, injecting a second fuel through at least one second fuel inlet into a second combustion zone, when operating the second combustion zone, injecting second zone air through at least one second air inlet at a second zone first air flow rate into the second combustion zone, mixing the second zone air and the second fuel to form a second fuel and air mixture, and combusting the second fuel and air mixture to generate second combustion gases, and when not operating the second combustion zone, injecting the second zone air at a second zone second air flow rate into the second combustion zone, the second zone second air flow rate being less than the second zone first air flow rate, wherein the first fuel and the second fuel are disparate fuels.

The method of the preceding clause, wherein the second combustion zone is disposed downstream of the first combustion zone.

The method of any preceding clause, wherein the first fuel is a relatively longer residence time fuel and the second fuel is a relatively shorter residence time fuel.

The method of any preceding clause, wherein the first fuel is Jet-A.

The method of any preceding clause, wherein the first fuel is sustainable aviation fuel.

The method of any preceding clause, wherein the second fuel is hydrogen.

The method of any preceding clause, further comprising injecting the second fuel and the second zone air in a trapped vortex combustor configuration, disposed downstream of the first combustion zone.

The method of any preceding clause, further comprising injecting second fuel and the second zone air in a tangential radial inflow combustor configuration, disposed downstream of the first combustion zone.

The method of any preceding clause, further comprising injecting second zone air at an increased flow rate when the second combustion zone is operating and at a reduced non-zero flow rate when the second combustion zone is not operating.

The method of any preceding clause, further comprising when operating a third combustion zone, injecting at least one third fuel into a third combustion zone, when operating the third combustion zone, injecting third zone air at a third zone first air flow rate into the third combustion zone, and when not operating the third combustion zone, injecting the third zone air at a third zone second air flow rate into the third combustion zone, the third zone third air flow rate being less than the third zone first air flow rate, wherein third fuel is of a similar residence time as the first fuel.

The method of the preceding clause, wherein the first combustion zone and the third combustion zone are axially aligned upstream of the second combustion zone.

The method of any preceding clause, further comprising injecting the at least one third fuel and the third zone air in a trapped vortex combustor configuration, downstream of the first combustion zone.

The method of any preceding clause, wherein one of the second combustion zone and the third combustion zone is disposed radially inside of the first combustion zone and the other of the second combustion zone and the third combustion zone is disposed radially outside of the first combustion zone.

The method of any preceding clause, wherein the second combustion zone is smaller than the third combustion zone.

The method of any preceding clause, further comprising causing the first fuel and air mixture to flow along a curved forward wall into the second combustion zone.

The method of any preceding clause, further comprising causing the third zone air to flow at an increased flow rate when the third combustion zone is operating and at a reduced non-zero flow rate when the third combustion zone is not operating.

The method of any preceding clause, further comprising mixing and injecting the first fuel and the first zone air via a TAPS injector-mixer assembly.

The method of any preceding clause, further comprising mixing and injecting the first fuel and the first zone air via a swirl cup mixer.

The method of any preceding clause, wherein the first combustion zone is a tangential radial inflow combustion zone.

The method of the preceding clause, wherein the tangential radial inflow combustion zone is a first tangential radial inflow combustion zone, the second combustion zone is a second tangential radial inflow combustor, the at least one first fuel inlet is arranged at a first fuel injection angle, the at least one first air inlet is arranged at a first air injection angle, the at least one second fuel inlet is arranged at a second fuel injection angle, greater than the first fuel injection angle, and the at least one second air inlet is arranged at a second air injection angle, greater than the first air injection angle.

The method of the preceding clause, further comprising causing the second combustion gases, or both the first combustion gases and the second combustion gases to flow from the second combustion zone to a turbine via second zone turbine vane transport cavities.

The method of the preceding clause, further comprising causing the first combustion gases to flow from the first combustion zone to the turbine via first zone turbine vane transport cavities.

A method of operating the combustor of any preceding clause, the method further comprising injecting the first zone fuel and the first zone air into the first combustion zone to form the first fuel and air mixture in the first combustion zone, combusting the first fuel and air mixture, when operating the second combustion zone in a first fuel configuration configuring the second combustion zone to a larger size, injecting the second zone first fuel into the second combustion zone, not injecting the second zone second fuel, injecting second zone air at the second zone first air flow rate into the second combustion zone to form the second zone first fuel and air mixture in the second combustion zone, and combusting the second zone first fuel and air mixture, and when operating the second combustion zone in a second fuel configuration configuring the second combustion zone to a smaller size, not injecting the second zone first fuel, injecting the second zone second fuel into the second combustion zone, injecting second zone air at the second zone second air flow rate to form the second zone second fuel and air mixture in the second combustion zone, and combusting the second zone first fuel and air mixture.

The method of the preceding clause, wherein the first zone fuel is of a same fuel as the second zone first fuel.

The method of any preceding clause, wherein the first zone fuel is Jet-A.

The method of any preceding clause, wherein the first zone fuel is sustainable aviation fuel.

The method of any preceding clause, wherein the second zone first fuel is Jet-A.

The method of any preceding clause, wherein the second zone first fuel is sustainable aviation fuel.

The method of any preceding clause, wherein the first zone fuel and the second zone first fuel are Jet-A or sustainable aviation fuel.

The method of any preceding clause, wherein the second zone second fuel is hydrogen.

The method of any preceding clause, wherein the second zone first fuel is of a longer residence time fuel than the second zone second fuel.

The method of any preceding clause, further comprising, when not operating the second combustion zone not injecting the second zone first fuel, not injecting the second zone second fuel, and injecting the second zone air at a second zone third air flow rate, lower than both the second zone first air flow rate and the second zone second air flow rate.

The method of any preceding clause, further comprising configuring the second combustion zone to the larger size by moving a movable forward wall to a forward position to define a larger volume and configuring the second combustion zone to the smaller size by moving the movable forward wall to an aft position to define a smaller volume.

The method of the preceding clause, further comprising actuating a linear shaft via an actuator, to move the movable forward wall.

The method of the preceding clause, wherein an inboard wall or an outboard wall is connected to the movable forward wall and is movable with the movable forward wall.

The method of any preceding clause, further comprising configuring the second combustion zone to the larger size by withdrawing a plurality of radial plugs and configuring the second combustion zone to the smaller size by inserting a plurality of radial plugs.

Although the foregoing description is directed to the preferred embodiments of the present disclosure, other variations and modifications will be apparent to those skilled in the art and may be made without departing from the disclosure. Moreover, features described in connection with one embodiment of the present disclosure may be used in conjunction with other embodiments, even if not explicitly stated above.

The invention claimed is:

1. A combustor of a turbine engine, the combustor comprising:

a first combustion zone operable to combust a first fuel and air mixture;

an injector-mixer connected to the first combustion zone;

at least one first fuel inlet connected to the injector-mixer, providing a first fuel to the first combustion zone via the injector-mixer;

at least one first air inlet connected to the injector-mixer, providing first zone air to the first combustion zone via the injector-mixer, the first fuel and the first zone air combining in the injector-mixer to form the first fuel and air mixture for delivery to the first combustion zone;

a second combustion zone for combusting a second fuel and air mixture, the second combustion zone being at least partially radially in line with the first combustion zone, wherein the second combustion zone has an axial dimension that is smaller than an axial dimension of the first combustion zone, and wherein the second combustion zone is located biased in an axially downstream direction of the first combustion zone, and wherein the second combustion zone is located radially inward of the first combustion zone;

at least one second fuel inlet connected directly to the second combustion zone, providing a second fuel to the second combustion zone, that operates when the second combustion zone is operating and does not operate when the second combustion zone is not operating; wherein the at least one second fuel inlet includes:

a forward wall fuel inlet entering the second combustion zone through a forward wall defining the second combustion zone;

an aft wall fuel inlet entering the second combustion zone through an aft wall defining the second combustion zone; and an inner wall fuel inlet entering the second combustion zone through a radially inner wall defining the second combustion zone;

at least one second air inlet connected directly to the second combustion zone, providing second zone air to the second combustion zone, the second fuel and the second zone air combining within the second combustion zone to form the second fuel and air mixture in the second combustion zone;

a third combustion zone disposed upstream of the second combustion zone for combusting a third fuel and air mixture, wherein the third combustion zone is located radially outward of the first combustion zone;

at least one third fuel inlet, connected directly to the third combustion zone, providing a third fuel to the third combustion zone, that operates when the third combustion zone is operating and does not operate when the third combustion zone is not operating; and at least one third air inlet, providing third zone air directly to the third combustion zone, the third fuel and the third zone air combining within the third combustion zone to form the third fuel and air mixture in the third combustion zone, wherein the first fuel and the second fuel are disparate fuels, and wherein the third fuel has a residence time similar to the first fuel.

2. The combustor of claim 1, wherein the first fuel is a relatively longer residence time fuel and the second fuel is a relatively shorter residence time fuel.

3. The combustor of claim 1, wherein the first fuel is Jet-A.

4. The combustor of claim 1, wherein the first fuel is sustainable aviation fuel.

5. The combustor of claim 1, wherein the second fuel is hydrogen.

6. The combustor of claim 1, wherein the second combustion zone is a trapped vortex combustion zone, at least partially disposed downstream of the first combustion zone.

7. The combustor of claim 1, wherein the second combustion zone is smaller than the third combustion zone.

8. A turbine engine comprising:

a compressor section that provides a compressed air flow;

a fuel system that provides fuel;

a combustor located downstream of the compressor section, the combustor receiving the compressed air flow and the fuel to form a fuel and air mixture, and combusting the fuel and air mixture to generate combustion gases, the combustor comprising:

a first combustion zone operable to combust a first fuel and air mixture;

an injector-mixer connected to the first combustion zone;

at least one first fuel inlet connected to the-injector-mixer, providing a first fuel to the first combustion zone via the injector-mixer;

at least one first air inlet connected to the injector-mixer, providing first zone air to the first combustion zone via the injector-mixer, the first fuel and the first zone air combining in the injector-mixer to form the first fuel and air mixture for delivery to the first combustion zone;

a second combustion zone for combusting a second fuel and air mixture, the second combustion zone being at least partially radially in line with the first combustion zone, wherein the second combustion zone has an axial dimension that is smaller than an axial dimension of the first combustion zone, and wherein the second combustion zone is located biased in an axially downstream direction of the first combustion zone, and wherein the second combustion zone is located radially inward of the first combustion zone;

at least one second fuel inlet connected directly to the second combustion zone, providing a second fuel to the second combustion zone, that operates when the second combustion zone is operating and does not operate when the second combustion zone is not operating, wherein the at least one second fuel inlet of the combustor includes:

a forward wall fuel inlet entering the second combustion zone through a forward wall defining the second combustion zone;

an aft wall fuel inlet entering the second combustion zone through an aft wall defining the second combustion zone; and an inner wall fuel inlet entering the second combustion zone through a radially inner wall defining the second combustion zone; and at least one second air inlet connected directly to the second combustion zone, providing second zone air to the second combustion zone, the second fuel and the second zone air combining within the second combustion zone to form the second fuel and air mixture in the second combustion zone;

a third combustion zone disposed upstream of the second combustion zone for combusting a third fuel and air mixture, wherein the third combustion zone is located radially outward of the first combustion zone;

at least one third fuel inlet, connected directly to the third combustion zone, providing a third fuel to the third combustion zone, that operates when the third combustion zone is operating and does not operate when the third combustion zone is not operating;

at least one third air inlet, providing third zone air directly to the third combustion zone, the third fuel and the third zone air combining within the third combustion zone to form the third fuel and air mixture in the third combustion zone; and a turbine section that is caused to rotate by the combustion gases, wherein the first fuel and the second fuel are disparate fuels, and wherein the third fuel has a residence time similar to the first fuel.

9. A combustor of a turbine engine, the combustor comprising:

a first combustion zone operable to combust a first fuel and air mixture;

an injector-mixer connected to the first combustion zone;

at least one first fuel inlet connected to the injector-mixer, providing a first fuel to the first combustion zone via the injector-mixer;

at least one first air inlet connected to the injector-mixer, providing first zone air to the first combustion zone via the injector-mixer, the first fuel and the first zone air combining in the injector-mixer to form the first fuel and air mixture for delivery to the first combustion zone;

a second combustion zone for combusting a second fuel and air mixture, the second combustion zone being at least partially radially in line with the first combustion zone, wherein the second combustion zone has an axial dimension that is smaller than an axial dimension of the first combustion zone, and wherein the second combustion zone is located biased in an axially downstream direction of the first combustion zone, and wherein the second combustion zone is located radially inward of the first combustion zone;

at least one second fuel inlet connected directly to the second combustion zone, providing a second fuel to the second combustion zone, that operates when the second combustion zone is operating and does not operate when the second combustion zone is not operating, wherein the at least one second fuel inlet includes:

a forward wall fuel inlet entering the second combustion zone through a forward wall defining the second combustion zone;

an aft wall fuel inlet entering the second combustion zone through an aft wall defining the second combustion zone; and an inner wall fuel inlet entering the second combustion zone through a radially inner wall defining the second combustion zone; and at least one second air inlet connected directly to the second combustion zone, providing second zone air to the second combustion zone, the second fuel and the second zone air combining within the second combustion zone to form the second fuel and air mixture in the second combustion zone, wherein the first fuel and the second fuel are disparate fuels.

10. The combustor of claim 9, wherein the at least one second air inlet includes:

a forward wall air inlet entering the second combustion zone through the forward wall defining the second combustion zone; and an aft wall air inlet entering the second combustion zone through the aft wall defining the second combustion zone.

11. The combustor of claim 1, wherein the at least one second air inlet includes:

a forward wall air inlet entering the second combustion zone through the forward wall defining the second combustion zone; and an aft wall air inlet entering the second combustion zone through the aft wall defining the second combustion zone.

12. The combustor of claim 11, wherein the at least one third fuel inlet includes:

a forward wall fuel inlet entering the third combustion zone through a forward wall defining the first combustion zone and the third combustion zone;

an aft wall fuel inlet entering the third combustion zone through an aft wall defining the third combustion zone; and an outer wall fuel inlet entering the third combustion zone through a radially outer wall defining the third combustion zone.

13. The combustor of claim 12, wherein the at least one third air inlet includes:

a forward wall air inlet entering the third combustion zone through the forward wall defining the first combustion zone and the third combustion zone; and an aft wall air inlet entering the third combustion zone through the aft wall defining the third combustion zone.

14. The combustor of claim 13, wherein the forward wall of the second combustion zone is located axially forward of the forward wall of the first combustion zone.

15. The turbine engine of claim 8, wherein the at least one second air inlet of the combustor includes:

a forward wall air inlet entering the second combustion zone through the forward wall defining the second combustion zone; and an aft wall air inlet entering the second combustion zone through the aft wall defining the second combustion zone.

16. The turbine engine of claim 15, wherein:

the at least one third fuel inlet of the combustor includes:

a forward wall fuel inlet entering the third combustion zone through a forward wall defining the first combustion zone and the third combustion zone;

an aft wall fuel inlet entering the third combustion zone through an aft wall defining the third combustion zone; and an outer wall fuel inlet entering the third combustion zone through a radially outer wall defining the third combustion zone; and the at least one third air inlet of the combustor includes:

a forward wall air inlet entering the third combustion zone through the forward wall defining the first combustion zone and the third combustion zone; and an aft wall air inlet entering the third combustion zone through the aft wall defining the third combustion zone.

* * * * *